United States Patent [19]

Iversen

[11] 4,455,504

[45] Jun. 19, 1984

[54] LIQUID COOLED ANODE X-RAY TUBES

[76] Inventor: Arthur H. Iversen, 15315 Sobey Rd., Saratoga, Calif. 95070

[21] Appl. No.: 445,212

[22] Filed: Nov. 29, 1982

Related U.S. Application Data

[63] Continuation-in-part of Ser. No. 250,275, Apr. 2, 1981, Pat. No. 4,405,876.

[51] Int. Cl.³ ..... H01J 35/12

[52] U.S. Cl. ..... 313/30; 313/35; 313/39; 378/141

[58] Field of Search ..... 313/30, 32, 35, 39, 313/330; 378/141, 142

[56] References Cited

U.S. PATENT DOCUMENTS 3,794,872 2/1974 Haas ..... 313/32 X 3,914,633 10/1975 Diemer et al. ..... 313/32

*Primary Examiner*—Eugene R. LaRoche

*Attorney, Agent, or Firm*—Michael Lechter

[57] ABSTRACT

There is disclosed a liquid cooled stationary anode tube wherein the anode is adapted for irradiation by an energy beam, and includes a heat exchange surface, said tube includes means for providing a flow of coolant liquid to remove heat from said heat exchange surface by formation of nucleate vapor bubbles on said heat exchange surface, said liquid tending to include a viscous sublayer adjacent to said heat exchange surface, the improvement wherein said heat exchange surface includes at least one of: means for forming pressure gradients in said liquid having a component perpendicular to said heat exchange surface to facilitate removal of said nucleate bubbles; and means for breaking up said viscous sublayer to facilitate removal of said nucleate bubbles.

60 Claims, 16 Drawing Figures

LIQUID COOLED ANODE X-RAY TUBES

CROSS REFERENCE TO RELATED APPLICATIONS

This is a continuation-in-part of application Ser. No. 250,275 filed by the present inventor on Apr. 2, 1981, which issued on Sept. 20, 1983 as U.S. Pat. No. 4,405,876.

DESCRIPTION

1. Technical Field

The present invention is directed to liquid cooled anode x-ray tubes, and in particular, x-ray tubes having a continuously cooled anode whereby high average power is achieved while still maintaining the high peak powers characteristic of rotating anodes.

2. Background of the Invention

The need for continuous duty, high power rotating anode x-ray tubes exists in medical radiography, i.e., fluoroscopy and computerized tomography (CT), and in industrial applications such as x-ray diffraction topography and non-destructive testing.

A number of schemes have been proposed in the past to achieve continuous power output at high peak power with a rotating anode x-ray tube. These include direct liquid cooling of the anode, liquid to vapor phase cooling of the anode, as well as other techniques.

A prior art scheme for liquid cooling rotating anodes is described in the Philips Technical Review, Vol. 19, 1957/58, No. 11, pp. 362–365. The rotating anode of the Philips device constitutes a hollow cylinder with three radially running tubes through which water flows to a cavity located along the inner surface of the peripheral wall or anode strip of the hollow body. In this device, the water flows back into the hollow drive shaft through three other tubes running radially in the rotary anode. However, various disadvantages have been attributed to the Philips device. For example, U.S. Pat. No. 4,130,772 to Kussel, et al, issued Dec. 1978, states that only relatively low speeds of rotation can be obtained with the Philips rotary device because the maximum thickness of the peripheral wall provided as the anode target member allowable for proper cooling is not sufficient to withstand the pressures in the cooling medium that arise due to centrifugal force at higher speeds of revolution. Only relatively small surface density of illumination (brightness) can be obtained with this known rotary anode, since the intensity of illumination, i.e., radiation per unit of surface, generated by a device depends upon the rate of anode revolution.

The Kussel, et al patent describes a liquid cooled rotating anode which purports to resolve the shortcomings of the Philips device. The portion of the rotary anode cylindrical peripheral wall, whereon the electron beam strikes, is cooled with water supplied and removed, respectively, through coaxial ducts distributed by radial ducts in one end face of the rotary to a ring duct and gathered from a ring duct at the other end face through another set of radial ducts leading back to the shaft. Between the two ring ducts, the cooling medium flows through helical cooling ducts running parallel to each other and at an angle of about 15° to the edge boundaries of the cylindrical operating surface. These ducts are formed on the outside by the anode peripheral wall material itself and on the inside by a stainless steel insert.

The Kussel device, although resolving the shortcomings of the Philips device, has several problems of its own—one of them, basic. To obtain efficient heat transfer, relatively high coolant velocities are required. To achieve high coolant velocities, high pump pressures are needed. Unfortunately, the seals necessary to join stationary to rotating fluid conduits generally have short lives when subjected to such high coolant pressures and high speed anode rotation.

A more basic limitation of the Kussel et al device arises from the use of the metal insert with grooves machined thereon to form the coolant ducts. The outermost rims of the groove walls are brazed to the anode peripheral wall. As described, the cooling ducts traverse one face of the anode to the other at a pitch angle of 15°. Therefore, the duct walls whose peripheries are brazed to the inside surface of the anode opposite the electron beam track also traverse one face of the anode to the other at the prescribed 15° angle. Therefore, the electron beam alternately travels over coolant duct and then duct wall as the anode rotates. When the electron beam is above the coolant, heat transfer is efficient, whereas when it is above the duct wall, it simulates more closely a solid metal structure, i.e., a conventional solid rotating anode. This creates a hot spot and severely limits the power handling capability because of the long heat path to the coolant. The braze alloy, used to braze the anode to the insert and which must melt well below the metals used, further limits the power densities that can be handled. The duct walls, brazed to the periphery of the anode, which provide the necessary strength to the anode shell to prevent the distortion due to centrifugal force of the coolant, become a liability in that they become a limiting factor in power handling capability.

U.S. Pat. No. 4,165,472, issued on Aug. 21, 1979, to Wittry describes a device utilizing a cooling technique typically referred to as "liquid to vapor phase cooling." In the preferred embodiment of the Wittry patent, a twostage system is used. The first stage consists of a sealed chamber in the anode that is filled with a coolant, such as water, that removes heat by vaporizing and recondensing on another portion of the internal anode surface that is cooled by a secondary liquid cooling loop. This in turn removes the heat to a heat sink external to the x-ray tube. In general, the various embodiments described are described as wickless heat pipes. One limitation is that heat transfer is limited by the diffusion rate of the vapor phase to the cool surface. A 6 kw capability is described in terms of a 12" diameter anode rotating at 5000 rpm. Directly cooled rotating anode x-ray tubes are rated at higher powers. Kussel discloses power capability of 100 kw. A further limitation on this structure is the sealed coolant chamber. A small amount of overheating can cause excessive pressures to be built up, i.e., bearing wear slowing the rotation. If the structure does not explode, it will bulge which will throw it out of balance, thereby rapidly wearing out the bearings.

U.S. Pat. No. 3,959,685, issued on May 25, 1976 to Konieczynski discloses a method whereby the heat capacity of a conventional, solid rotating anode x-ray tube can be increased. This is accomplished by sealing slugs of high heat capacity and selected melting point metal into the anode. When the anode reaches a critical temperature, the slugs melt, absorbing more heat. Upon cooling, they re-solidify. A 20% increase in heat capacity is mentioned. The limitation of this device is that should the melted slugs overheat and create excessive pressures due to target slowdown or stoppage (frozen bearings), it truly becomes a bomb with molten metal spewing out. This makes in unacceptable for medical use. Any irregularities in resolidification of the slugs, due to small differences in cooling rates or irregular crystal formation, will cause an imbalance in the anode with resultant early bearing failure.

U.S. Pat. No. 3,719,847 issued on Mar. 6, 1973 to Webster povides a hollow anode in which a liquid metal such as sodium or lithium is confined. Heat from the electron beam is striking the cathode which causes the liquid metal to evaporate, thereby effectively increasing the heat capacity of the anode. With no means to extract the heat, cooling is by radiation as with a conventional solid anode. Should the anode overheat, due to bearing wear, etc., the confined metal vapor will build up excessive pressure and the vessel can explode with subsequent danger to personnel in the vicinity.

U.S. Pat. No. 4,146,815, issued Mar. 27, 1979, to Childenc, also discloses a hollow anode filled with a liquid metal much like that disclosed in Webster. It suffers from the same limitation of retaining the characteristic of a solid anode that must cool by radiation. It also possesses the potential of exploding like a bomb should it overheat due to bearing wear caused by age or imbalance.

U.S. Pat. No. 3,736,175, issued May 22, 1973, to Blomgren, discloses a heat pipe to transmit heat from the anode to an external heat sink. Notwithstanding the efficacy of external electrostatic cooling, a heat pipe depends on the diffusion rate of the coolant vapor to the cool end for the rate of heat removal. The power densities that can be handled are relatively low. For the power levels required, a huge and impractical heat pipe would be needed, i.e., 50 kw dissipation.

U.S. Pat. No. 3,794,872, issued Feb. 26, 1974 to Haas, discloses a fixed target anode cooled by a jet of fluid. The target is mounted on a bellows such that "the target reciprocates laterally in a direction perpendicular to the axis of the tube but the target does not rotate on its own axis." As the focal spot wears out, i.e., pits, the target is moved to a new position to provide fresh target surface. In this manner, the effective life of the tube is extended considerably. The motion provided is not rotational and therefore does not increase the output power of the tube. As a fixed target tube, its power output is low.

A prior art alternative to the respective Phillips and Kussel et al approaches to dissipation of large power loads is that of Taylor as described in Advances in X-ray Analysis, Vol. 9, August 1965, G. R. Mallett, et al, Plenum Press, N.Y. In the Taylor design, the liquid coolant flows transverse to the direction of anode rotation and interacts with the anode in a manner known as "linear coolant flow." However, although there is a high relative velocity between the anode and coolant, the interaction is relatively inefficient and is reported by Taylor to provide only relatively low power ($7\frac{1}{2}$ kw). This stands in sharp contrast to the 100 kw attributed to the Kussel design. However, the Taylor design is not subject to performance-limiting centrifugal forces as the Philips device is, and permits the use of low pressure pumps and components.

Further description of prior art liquid cooled rotating anode x-ray tubes is found in the following articles:

G. Fournier, J. Mathieu: J. Phys. 8, 177(1937)
R. E. Clay: Proc. Phys. Soc. (London) 46, 703 (1934)
R. E. Clay, A. Miller: J. Instr. Elect. Engs. 84, 261 (1939)
W. T. Astbury, R. D. Preston: Nature 24, 460 (1934)
Z. Nishiyama: J. Japan Met. Soc. 15, 42 (1940)
V. Linnitzki, V. Gorski: Sov. Phys-Tech. Phys. 3, 220 (1936)
R. R. Wilson: Rev. Sci. Instr. 12,91 (1941)
S. Miyake, S. Hoshino: X-sen 8,45 (1954) (Japanese)
Y. Yoneda, K. Kohra, T. Futagami, M. Koga: Kyushu Univ. Engs. Dept. Rep. 27,87 (1954)
S. Kiyona, M. Kanayama, T. Konno, N. Nagashita: Technol. Rep., Tohoku Univ. XXVII,103 (1936)
A. Taylor: J. Sci. Instr. 26,225 (1949); Rev. Sci. Instr. 27,757 (1956)
D. A. Davies: Rev. Sci. Instr. 30,488 (1959)
P. Gay, P. B. Hirsh, J. S. Thorp, J. N. Keller: Proc. Phys. Soc. (London) B64,374 (1951)
A. Muller: Proc. Roy. Soc. 117,31 (1927)
W. T. Astbury: Brit. J. Rad. 22,360 (1949)
E. A. Owen: J. Sci. Instr. 30,393 (1953)
K. J. Queisser: X-ray Optics, Applications to Solids Verlag-Springer, N.Y. (1977), Chap. 2
Longley: Rev. Sci. Instr. 46,1 (1975)
Mayden: Conference on Microlithography, Paris, June 21-24, 1977, pp. 196-199
MacArthur: Electronics Eng. 17,1 (1944-5)
A. E. DeBarr: Brit. J. Appl. Phys. 1,305 (1950)

SUMMARY OF THE INVENTION

The present invention provides a liquid cooled rotating anode x-ray tube that possesses the high power capabilities of the Kussel type design while using low pressure pumps and components. The present invention further provides liquid cooled stationary target (anode) x-ray tubes with improved power capabilities.

The present invention also provides a high power, continuous duty liquid cooled rotating anode x-ray tube, wherein the rate of heat removal, and the critical heat flux (burn out), are increased as compared to prior art liquid cooled rotating anode x-ray tubes, and which tube is capable of long life at continuous power.

The present invention further provides for simultaneous and continuous liquid cooling of the entire heat exchange surface of a hollow rotating anode x-ray tube thereby avoiding any power limiting hot spots.

In addition, the present invention provides for a high relative velocity of the anode to coolant liquid with low fluid velocities, long lived rotational fluid seals, and permits the use of low pressure fluid pumps and components.

The present invention provides a liquid cooled stationary target (anode) x-ray tube with many of the advantages described for the liquid cooled rotating anode x-ray tube.

The foregoing is accomplished in accordance with the present invention by providing the heat exchange surface of the anode with a contoured surface, i.e., with a predetermined varying geometry, a calculated surface roughness, or both, to promote nucleate boiling and bubble removal.

DETAILED DESCRIPTION OF PREFERRED EXEMPLARY EMBODIMENTS

Figure 1:
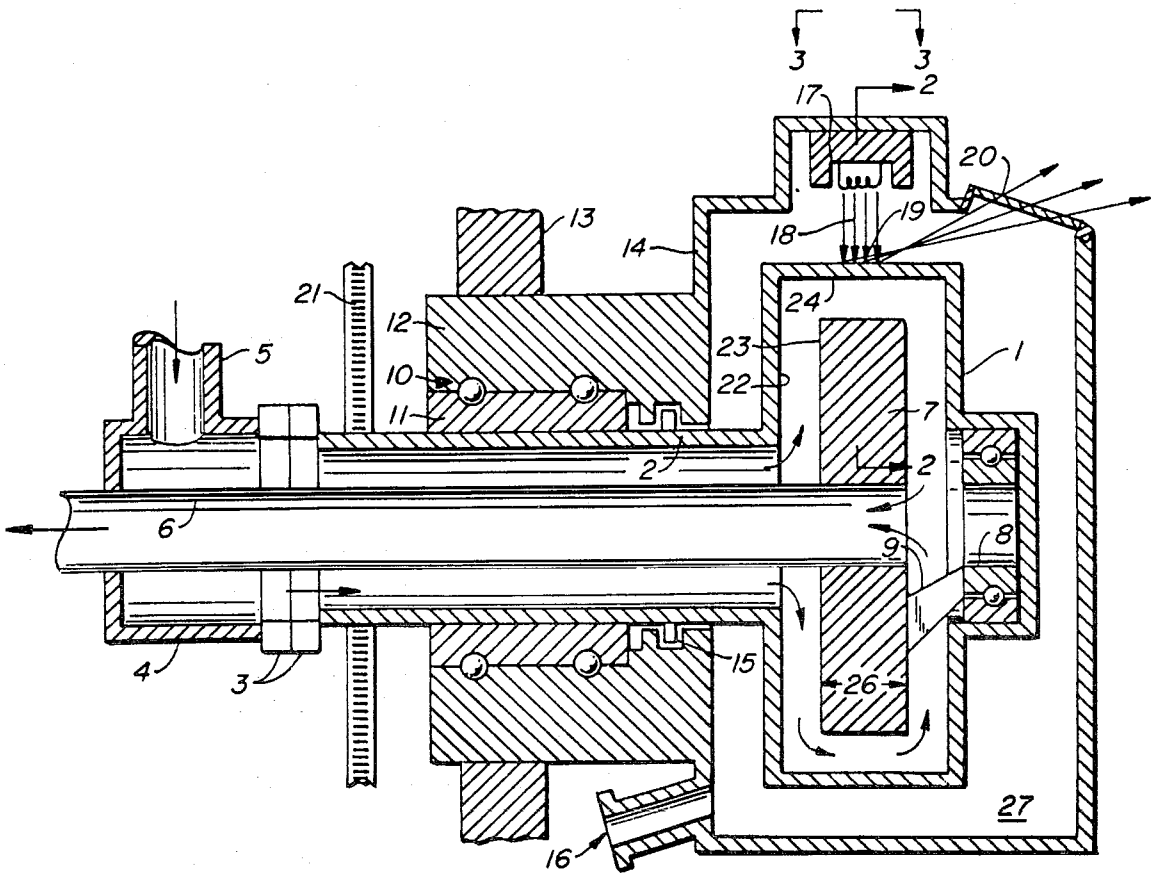
FIG. 1 is a complete cross-section of a rotating anode x-ray tube according to the present invention.

The basic cooling mechanism in liquid cooled anodes for use in x-ray tubes is nucleate boiling (or other vapor or gas mechanism). In nucleate boiling, bubbles of vaporized fluid are generated on the anode heat exchange surface. The vapor bubbles break away and are replaced by fresh bubbles, much like a pot of boiling water, thus providing efficient cooling by the removal of heat from the exchange surface to vaporize the liquid. In film boiling, however, the power handling capacity of the system is limited by transformation of the nucleate boiling mechanism into destructive film boiling (or other vapor or gas blanket). The heated surface is surrounded by a vapor blanket which insulates the heated surface, thus causing significantly reduced heat transfer. The primary heat removal mechanism therefore becomes radiation and convection of the vapor.

The heat flux at the transition from nucleate to film boiling is called the critical heat flux. Should this value be exceeded in electrically heated structures such as a liquid cooled x-ray tube anode, the insulating film blanket would cause a rapid rise in temperature, typically resulting in burn out (i.e., melt down) of the structure. In general, this occurs so quickly, or the protective means required are so elaborate or expensive, that adequate protection is not practical.

Formation of the boiling film occurs when expanding bubbles are generated faster than they can be carried away. The expanding nucleate bubbles interact and combine ultimately to form an insulating blanket of vapor. Thus, the transition is made from nucleate boiling to film boiling. It is the bubble interaction which controls the heat transfer process.

To provide for efficient heat removal from the liquid cooled inner surface of the anode, i.e., at the anode heat exchange surface, a high relative velocity between the anode heat exchange surface and the liquid, approximately 50 feet per second or greater, is required. The anode heat exchange surface is that surface on the inside liquid cooled surface of the hollow rotatable anode to which substantially all the heat generated by the electron beam striking the electron beam track is transmitted. The anode heat exchange surface is generally larger than the surface illuminated by the electron beam track and is also generally centered on the electron beam track.

In the prior art previously described, high pressure pumps have been used to achieve the desired high liquid velocity. Shortened rotational fluid seal life and attendant anode design limitations, previously noted, result. To obviate these design limitations, use is made in accordance with one aspect of the present invention, of the high rotational velocity present in rotating anode x-ray tubes. A state-of-the-art rotating anode tube operates at 10,000 rpm and is 4 inches in diameter. The rotation of the anode can thus provide a surface velocity at its periphery of about 170 feet per second, considerably greater than the desired minimum (50 feet per second).

Such high rotational velocity of the anode is required to achieve the high peak powers obtained in conventional rotating anode x-ray tubes. The present invention combines relatively low velocity liquid which traverses the path of anode rotation, with the high rotational velocity of the anode to establish necessary (but not sufficient) conditions for highly efficient heat removal.

As previously discussed, it is the presence of nucleate bubbles which cling tenaciously to the anode surface, their rate of formation, their interaction and their rate of removal that determine the critical heat flux, i.e., burn out, and the rate of heat removal. To raise the critical heat flux and simultaneously increase the rate of heat removal, the present invention provides means whereby nucleate bubbles are more rapidly removed. In addition, one series of embodiments provides for an increase in nucleation sites as well as optimizing their geometry and distribution. Thus, more nucleate bubbles of specified geometry and quantity are generated and removed, thereby increasing the heat flux.

The adherence of nucleate bubbles to the anode heat exchange surface is related to such factors as surface tension, viscosity, temperature, bubble size, etc. There are two basic methods for increasing their rate of removal. One approach is to create a pressure gradient in the fluid perpendicular to the anode surface. The higher the gradient, the faster the rate at which bubbles break loose. This is the principal by which the Kussel et al device achieves a stated 100 kw output. In the Kussel et al and Philips designs, the centrifugal force generated by the fluid as it is pumped at high velocities around the inside circumference of the anode generates high gradients. Thus, the nucleate bubbles break loose more rapidly thereby significantly increasing the heat transfer.

The work of Gambill and Greene at Oak Ridge National Laboratories (Chem. Eng. Prog. 54,10 1958) theoretically and experimentally demonstrated that by using a vortex coolant flow in a heated tube, power dissipations 4 to 5 times greater than that possible by linear coolant flow could be achieved. The vortex flow, a helical motion of the coolant down the inside of a heated tube, generates pressure gradients normal to the tube wall by centrifugal force and, according to Gambill and Greene, provides a mechanism "of vapor transport (nucleate bubble removal) by centrifugal acceleration."

In the present invention, a gradient in the fluid is obtained by periodically varying, i.e., contouring, the inner surface geometry of the anode in the proximity of the electron beam track. That is, the anode wall thickness in the proximity of the electron beam track is varied in a periodic manner so as to generate periodic curves at the coolant interface. The anode surface at the electron beam track is circular. Thus, as the anode rotates, the liquid transversing the anode path periodically has a pressure gradient perpendicular to the anode wall generated by the changing anode wall thickness, i.e., a pumping action caused by the changing radius as measured from the axis of rotation of the anode to the liquid heat exchange surface of the anode. The inertia of the liquid being displaced at the anode surface creates the gradient. A number of geometries are available to create the desired gradient. The anode heat exchange surface with periodic curves generated thereon may be described, and will hereinafter sometimes be referred to, as a contoured surface.

The viscous or laminar sublayer—a thin layer of laminar flow adjacent to the wall of the conduit and always present in turbulent flow—provides a mechanism to further cause the nucleate bubbles to adhere more readily to the anode surface. The second method of increasing the rate of nucleate bubble removal is by breaking up this viscous or laminar sublayer. The viscous layer can be broken up by roughening the anode coolant surface. The roughened anode heat exchange surface may also be described as a contoured surface. A contoured surface is herein defined as any surface condition or geometry designed to improve heat transfer from the anode heat exchange surface to the liquid coolant. When the height of the roughening projections ranges from 0.3 times the thickness of the viscous sublayer to the sum of the thickness of the viscous sublayer and a transition zone adjacent the viscous sublayer, the sublayer is broken up. Breaking up the viscous sublayer enables the turbulent fluid to reach the base of the nucleate bubble, where it is attached to the anode, thereby providing the energy needed to break it loose.

The thickness of the viscous sublayer is a function of the Reynolds number $R_n$ (the ratio of inertia forces to viscous forces) as used in fluid mechanics. The dimensionless Reynolds number is used to characterize the type of flow in a hydraulic structure where resistance to motion is dependent upon the viscosity of the liquid in conjunction with the resisting forces of inertia and is given by the equation:

$$R_n = \frac{\rho}{u} V \frac{A}{P}$$

wherein $\rho$=density of the fluid
u=viscosity of the fluid
V=velocity of the fluid
A=area of fluid in conduit
P=wetted perimeter of conduit
A/P=hydraulic radius Thus, for a given fluid, of specific density and viscosity, the Reynolds number defines the relationship between the fluid velocity and conduit geometry. Most efficient heat transfer is obtained with turbulent fluid flow as compared to laminar fluid flow. Turbulent fluid flow is characterized by a Reynolds number of at least 2000. However, with very rough surfaces, turbulent flow can be obtained at a Reynolds number of 1000.

The geometry of nucleate bubbles is a function of the surface roughness geometry; small fissures tend to generate small nucleate bubbles, whereas large fissures tend to generate larger ones. Therefore, nucleate bubble size and generation can be optimized by providing a surface of calculated and preferably uniform roughness and geometry. A surface having such roughness geometry may also be considered as a contoured surface as defined above. A regular roughness geometry can be obtained by suitable conventional techniques such as, for example, chemically by means of chemical milling; electronically, by the use of lasers or electron beams; of mechanically, by broaching, hobbing, machining, milling, stamping, engraving, etc.

Another method of obtaining a surface with crevices for forming nucleate bubbles is the use of a thin porous metal layer adherent to the anode at the anode heat exchange surface. This porous metal layer may be considered to provide a contoured surface as defined above. Relatively uniform pore size can be obtained by fabricating the porous structure from metal powders with a narrow range of particle sizes. Methods, such as described in U.S. Pat. No. 3,433,632, are well suited to providing the desired porous metal structure.

Thus, optimum cooling can be obtained by combining a calculated surface roughness with generated curves on the anode cooling surface. The surface roughness generates nucleate bubbles of uniform dimensions and breaks up the viscous or laminar sublayer which causes the bubbles to adhere more readily to the anode surface. The gradient generated by the periodic curves on the anode coolant surface further assists in causing the nucleate bubbles to be rapidly carried away.

A fully roughened conduit surface induces large frictional losses in liquids with attendant pressure drop. The pressure drop is related to the length of roughened surface. In the preferred embodiment of the present invention, the roughened anode surface width, or length of the roughened surface in the direction of liquid flow, ranges from 1 to 9 times the width of the electron beam track and is generally on the order of one-quarter to two-inches wide. Thus, the pressure drop due to the roughened surface, i.e., a roughness height ranging from 30% that of the viscous sublayer thickness to approximately equal to the combined thickness of the viscous sublayer and the transition zone, is minimal. Surfaces having roughness heights less than 30% of the viscous sublayer thickness are effectively smooth. Increasing the roughness height beyond that described can result in dead spots at the base of the roughness elements. This will adversely effect the heat transfer characteristics. Increasing the spacing between roughness elements to minimize the dead spots will result in fewer nucleation sites per unit area, with consequent reduction in heat flux. In addition, the pressure drop increases with consequent increase in required pumping power. Thus, for a specific fluid, i.e., viscosity and density, optimum geometries can be specified.

In general, liquid cooled anodes such as the previously described Philips and Kussel et al devices are characterized by conduit geometries at the heat exchange surface with long lengths and small cross-sections. Contoured surfaces in such conduit geometries could result in excessive pressure drop. In contrast, one aspect of the present invention provides a heat exchange surface having a short length and a large cross section. This permits the use of fully roughened heat exchange surfaces with minimum pressure drop.

In addition, the small ratio of length (L) to diameter (D) of the conduit as compared to large L/D ratios as are present in the Kussel et al design, results in greater heat flux, i.e., heat transfer, per unit area. The rule of thumb is that each halving of the L/D ratio increases the heat flux by 15%.

To minimize the pressure drop further and not induce significant rotational velocity to the liquid, a thin stationary sleeve can be placed in close proximity to the inside diameter of the outer rotating shaft used to impart rotation to the anode. The sleeve proceeds the full length of the shaft and flares to a funnel shape in the anode so as to retain close proximity. It terminates shortly before reaching the heat exchange surface of the anode. Thus, minimal rotational velocity is transmitted to the liquid from the outer rotating shaft. Another method to minimize induced rotational velocity in the liquid is to place thin longitudinal vanes external to the inner stationary sleeve which separates the incoming from the outgoing liquid. The vanes extend to close proximity to the inner wall of the hollow rotating shaft and continue into the anode, terminating just before the anode strip. The vanes serve to dampen any induced rotational velocity in the liquid caused by contact with the inside diameter of the outer rotational shaft.

Thus, the design criteria have now been established for optimum heat transfer in liquid cooled rotating anode x-ray tubes. They are as follows:

1. Utilize the high rotational velocity of the anode to obtain the desired high relative anode to liquid velocity.

2. Provide relatively low velocity liquid flow that traverses the path of anode rotation.

3. Maintain a Reynolds number of at least 1000 at the anode heat exchange surface.

4. In the proximity of the electron beam track, provide periodic variations in the wall thickness of the hollow rotatable anode so as to generate periodic curves at the heat exchange surface; the outer surface of the anode containing the electron beam remaining circular.

5. In the proximity of the electron beam track, provide a calculated surface roughness at the anode heat exchange with roughness projections of heights ranging from 0.3 times the thickness of the viscous sublayer to equal the sum of the thickness of the viscous sublayer and the transition zone to break up the viscous sublayer.

Using design criteria 1 and 2 alone results in a circular anode surface at the liquid interface with a smooth surface, i.e., surface roughness less than 0.3 of the thickness of the viscous sublayer. Even with the high anode to liquid velocity, poorer heat transfer and lower critical heat flux result because the nucleate bubbles will adhere more readily to the anode surface inasmuch as there is no pressure gradient generated to induce them to break away, other than those normally generated by surface tension and other minor factors, such as shear forces and transmitted turbulence. Therefore, the bubbles become larger and remain longer and have a greater tendency to interact to form the insulating vapor blanket of film boiling. Thus, poorer heat transfer and lower critical heat flux, i.e., burn out, result.

This is much like spinning a cup of water on its axis. The water remains essentially stationary while the cup spins and then slowly picks up rotational velocity. Were the inside surface of the cup contoured, i.e., roughened and/or provided with periodic curves as described, the water would agitate quickly thereby providing improved interaction with the cup wall, i.e., improved heat transfer.

The use of a gradient to provide efficient heat removal is shown by the previously-described Kussel et al device. In that device, the liquid is pumped essentially circumferentially around the anode, i.e., at 15° to the path of anode travel. The change in direction, i.e., centrifugal force, of the liquid as it travels along the inner surface of the peripheral wall induces the desired gradient. Kussel et al reports 100 kw with this design. The present invention will achieve the same results without the described shortcomings of the Kussel et al design.

Referring now to FIG. 1, the basic structure of a preferred exemplary embodiment of the present invention will be described. A hollow anode 1 attaches to a hollow rotating shaft 2. A rotational fluid seal 3 is mounted at the end of hollow shaft 2. A stationary cupped cylindrical attachment 4 with entrance duct 5 is mounted to rotational fluid seal 3. A stationary tube 6 is disposed concentrically with, and extends through, stationary hollow cupped cylindrical attachment 4; a hermetic seal is provided between attachment 4 and stationary tube 6. Stationary tube 6 extends longitudinally, and concentrically, within hollow rotatable shaft 2 into the hollow rotatable anode 1. A stationary septum 7 is mounted on hollow stationary tube 6, and disposed within hollow anode 1. Hollow anode 1 is rotatably coupled to stationary septum 7 by a rotational bearing 8 and a fin radial support and centering means 9 attached to inner, stationary segment of bearing 8.

A rotatable bearing member 10, including an inner rotating segment and outer stationary segment 12 is utilized to rotatably couple rotatable shaft 2 to a mounting member 13 and to a vacuum envelope 14. Inner rotating segment 11 of rotatable bearing member 10 is fastened to the outside diameter of hollow rotatable shaft 2. Outer stationary segment 12 of rotatable bearing member 10 is fastened to mounting member 13 and a vacuum envelope 14. Suitable rotatable high vacuum sealing means 15, such as ferrofluidic seal, is incorporated in bearing 10 to vacuum seal stationary member 12 to rotatable shaft 2 to facilitate provision of a vacuum within vacuum envelope 14, surrounding anode 1. An electron gun 17 is mounted within vacuum envelope 14. Electron gun 17 provides an electron beam 18 focussed upon an electron beam track 19 on the exterior periphery of anode 1. Illumination of anode 1 by beam 18 causes generation of x-rays which exit through a vacuum tight x-ray transparent window 20 in vacuum envelope 14.

Pulley 21, or other means, is connected to a suitable motor by a belt (not shown) to provide rotational drive to shaft 2 and, thus, anode 1. A port 16 is provided in envelope 14 for attachment to means, not shown, to obtain or maintain the necessary vacuum within the evacuated space 27. The vacuum may be generated by, for example, barium, titanium, or zirconium getters or VAC-Ion, titanium sublimation, cryogenic, turbomolecular, diffusion or other vacuum pumps.

The basic structure of FIG. 1, having been described above, functions as follows. Cooled fluid from an external heat exchanger and pump assembly (not shown) is pumped into the x-ray tube through duct 5. The coolant then travels toward the anode 1 between the outer diameter of stationary inner tube 6, and the inner diameter of rotatable hollow shaft 2. The coolant then passes along inside input face 22 of anode 1 and outside of input face 23 of septum 7, until it reaches the anode heat exchange surface 24.

Specific designs for the rapid removal of nucleate bubbles are applied to the anode heat exchange surface 24. The aforementioned periodic curves and calculated surface roughening are provided only on an area of the anode heat exchange surface 24 generally centered directly below the electron beam track 19 and are typically 1 to 9 times the width or greater (depending on focal spot size and anode wall thickness) of the electron beam track 19.

The septum 7 serves to direct the entire coolant flow into close proximity to the anode heat exchange surface by providing a narrow channel between the septum 7 and anode heat exchange surface 24. The width of the septum 26 is typically greater than the width of the electron beam track and is generally centered with the electron beam track. The spacing between the septum and the anode heat exchange surface is designed to maintain optimum flow and heat exchange conditions. The geometry is always such that the entire heat exchange surface of the anode, i.e., the generated curves and/or the roughened surface, is simultaneously and continuously exposed to coolant flow. In this manner, the entire heat exchange surface is continuously cooled and hot spot cannot develop due to interrupted coolant availability. Thus, optimum heat transfer is obtained and maintained.

Having passed over the anode heat exchange surface 24 to 25, the heated coolant now passes the outboard faces of the anode inside surface and septum, past support fins 9 and out through the inside of stationary tube 6. From there, the coolant proceeds to the external heat exchanger pump (not shown) and back to the x-ray tube.

It is desirable that the temperature rise at the rotatable vacuum seal 15 be minimized. The ferrofluidic vacuum sealing fluids have viscosity and vapor pressure characteristics that are very sensitive to temperature with the typical maximum operating temperature being 50° C. Accordingly, the cooled liquid is passed between the outer diameter of inner tube 6 and the inner diameter of rotatable shaft 2. This passed cooled input liquid against the vacuum seal, to maintain minimum temperatures and thus optimize operating conditions. Reversing the direction of flow would pass heated liquid next to the vacuum seal, raising the temperature of the seal. The increased seal temperature tends to cause degradation of operating characteristics, such as reducing permissible operating rpm and degrades the vacuum due to the increased vapor pressure of the heated ferrofluids. However, with a suitable cooling and insulating scheme for the vacuum seal, the coolant flow direction could be reversed which has advantages with respect to minimizing induced rotational velocity in the liquid flow.

Figure 2:
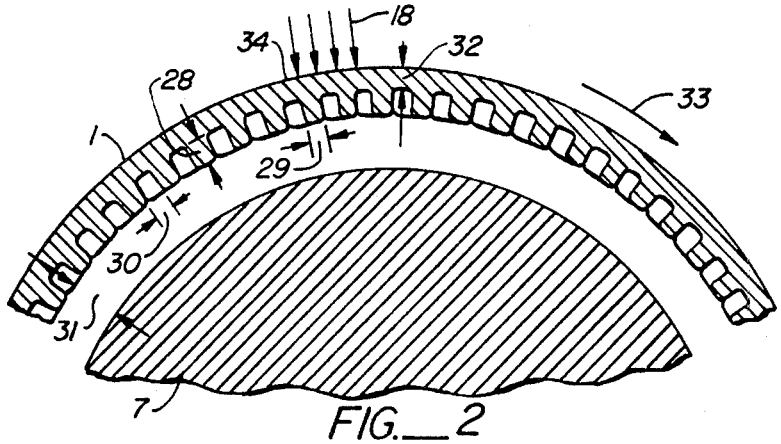
FIG. 2 is a partial cross-sectional view of rotating anode heat exchange surface illustrating roughened surface.
Figure 4:
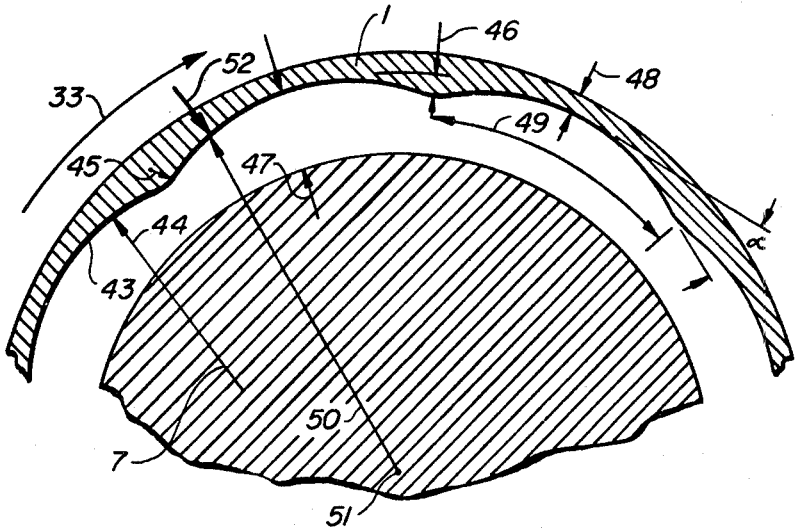
FIG. 4 is a partial cross-sectional view of rotating anode heat exchange surface, illustrating flutes with rounded cusps.
Figure 5:
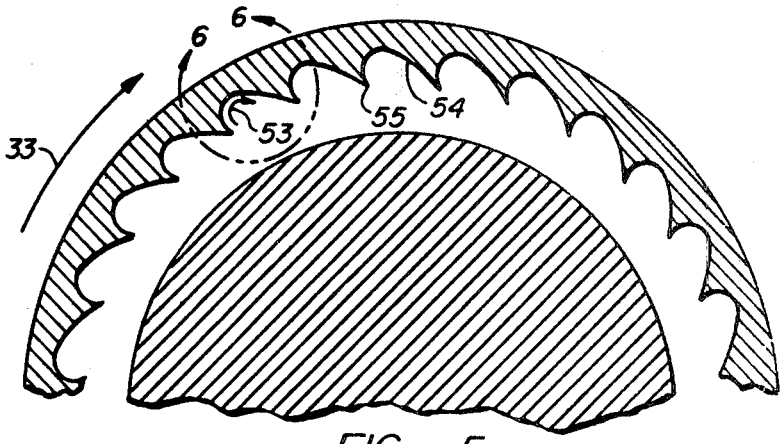
FIG. 5 is a partial cross-sectional view of rotating anode heat exchange surface illustrating flutes with cusp tips "rolled" over in the direction of anode rotation so as to induce swirl flow conditions.

Respective alternative cross sections along view 3—3 in FIG. 1 are shown in FIGS. 2, 4 and 5 to illustrate examples of contoured surface geometries that serve to increase heat flux and raise the critical heat flux at the anode heat exchange surface. The contoured surface portions of the heat exchange surface are generally centered beneath the electron beam track and range in widths from 1 to 9 times (or greater for small focal spots) that of the electron beam track. The width is dictated by parameters such as anode thermal conductivity and wall thickness, heat exchange surface geometry and coolant characteristics. In general, the septum is stationary while the anode rotates to minimize induced rotational velocity in the coolant flow.

Figure 3:
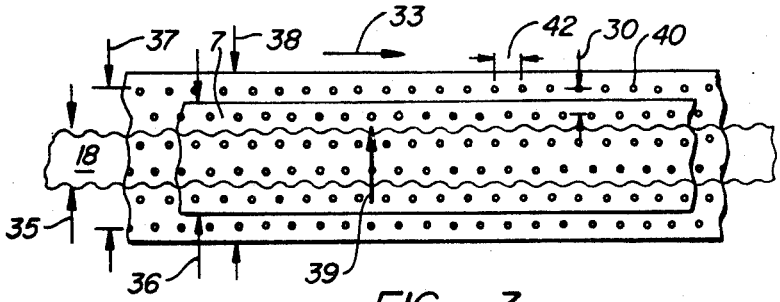
FIG. 3 is a partial vertical view of rotating anode heat exchange surface, illustrating a roughened surface.

FIGS. 2 and 3 illustrate a contoured surface comprising a roughened surface at the anode heat exchange surface as shown in FIG. 2. Roughness projections having height, width and spacing generally indicated as 28, 29 and 30, respectively, are provided on the heat exchange surface of the anode 1. The projections are in alignment with septum 7, spaced from septum 7 by a distance generally indicated at 31. Height 28, width 29 and spacing 30, as well as septum 7, anode 1, spacing 31 and anode wall thickness 32, are designed to provide optimum heat transfer. Anode rotation 33 and the electron beam 18 striking the anode strip 34 are shown.

Referring now to FIG. 3, the widths of electron beam 18, septum 7, the contoured portion of the heat exchange surface and face are generally indicated as 35, 36, 37 and 38, respectively. Septum width 36 and roughness width 37 are generally equal to or greater than the electron beam track width 35. Electron beam track width 35 is less than the anode face width 38 for all cases. The roughness width 37 is generally greater than the septum width 36. Liquid flow, generally indicated as 39 (FIG. 3) passes between septum 7 and anode 1 (FIG. 2), traversing the path of anode rotation 33 (FIG. 3). The direction of liquid flow 39 is shown 90° (normal) to anode rotation 33. However, in any of the heat exchange configurations, the liquid flow vector 39 can be rotated to provide a velocity component with or against the direction of anode rotation to further optimize heat transfer. Roughness elements (projections) 40 are spaced along the direction of coolant flow at a distance generally indicated as 42. Roughness element 40, spacings 30 and 42, as well as height 28 (FIG. 2) and shape, are designed to provide optimum heat transfer based on parameters such as fluid viscosity, density, boiling characteristics, thermal characteristics and geometry of the anode, electron beam power densities, etc. Once the benefits of break-up of the viscous sublayer are achieved, further increase in roughness element height generally reduces the efficiency of heat transfer by increasing the possibility of dead spots at the roughness base between roughness elements and increasing the thermal impedance of the roughness element.

An alternative contoured surface is shown in FIG. 4, using periodic curves in the shape of flutes, with rounded cusps. Flutes 43 of radius 44 and rounded cusp radius 45 are provided on the inside surface of anode 1. Flute height and period are generally indicated as 46 and 49, respectively. Flute heigh 46, flute radius 44, cusp radius 45 and flute period 49 are designed for optimum heat transfer for a given liquid, anode metal, power density, anode rotational velocity, etc. The maximum angle $\alpha$ formed by the rounded cusp is 20°, with minimum breakup in liquid flow occuring at 7°.

Anode rotation in the direction indicated by arrow 33 provides the high relative anode to liquid velocity required for generating a pressure gradient at the anode surface. The changing radius 50, generated by the flute as measured from the axis of rotation of the anode 51, causes inward displacement of the fluid inducing in the liquid a radial inward force 52 along the radius of the flute. It is this force, i.e., an artificial gravity, that generates the pressure gradient that assists in more rapidly breaking loose and carrying away the nucleate bubbles. Rounding the cusps to radius 45 minimizes eddies and break-up of the liquid flow as it passes over the cusps, thus maintaining efficient heat transfer.

Figure 6:
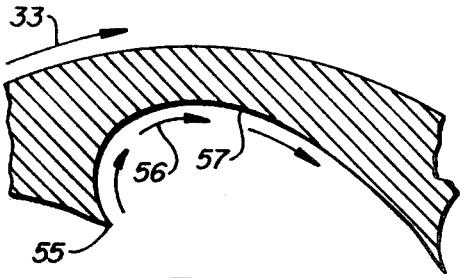
FIG. 6 is an enlarged view of a single flute as depicted in FIG. 5.

A further alternative contoured surface is shown in FIG. 5, using a geometry that induces swirl flow, generally indicated as 53, of the coolant along the surface of the anode. The geometry uses a modified flute shape 54, wherein the cusp tip 55 is "rolled" over in the direction of anode rotation 33. An enlarged breakout is shown in FIG. 6. As the liquid traverses the path of anode rotation 33, it is "scooped" up by rolled-over cusp tip 55. The centrifugal force generated by the liquid as it flows (indicated by arrow 56) rapidly along the curved surface 57 creates a gradient perpendicular to the anode heat exchange surface that more readily breaks loose nucleate bubbles. The efficiency of the swirl flow configuration may be enhanced by angling the swirl flow structure with respect to the path of anode rotation. FIGS. 5 and 6 depict the swirl flow structure normal to the plane of rotation 33 of the anode.

Figure 7:
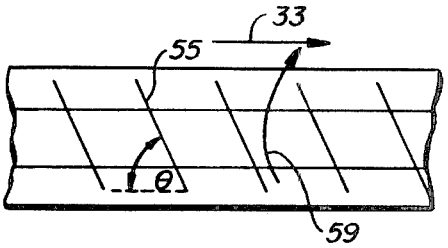
FIG. 7 is a partial vertical view of rotating anode heat exchange surface illustrating flutes and "rolled" cusps angled at other than 90° to direction of anode rotation.

FIG. 7 schematically illustrates a contoured surface wherein the swirl flow structure is placed at an angle $\theta$ with the path of rotation 33 of the anode. Angling the swirl flow geometry serves to provide a component of velocity in the direction of liquid flow thereby minimizing back pressure generted by vaporized liquid or other causes. In so doing, it maintains optimum swirl flow conditions. The path of the swirl flow is represented by arrow 59.

To enhance further the interaction of the liquid with the anode heat exchange surface, the spacing between the septum and the anode may either converge or diverge in the direction of liquid flow or may be a complex curve which combines both convergence and divergence. This geometry serves to optimize further the local liquid flow characteristics in the region of the heat exchange surface. An example of such a structure is shown in FIG. 8.

Figure 8:
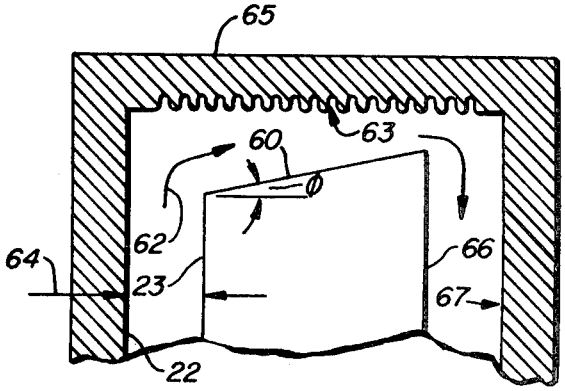
FIG. 8 is a partial cross-sectional view of rotating anode heat exchange surface illustrating a converging spacing, in the direction of fluid flow, between anode and septum, with the septum geometry varying and the anode heat exchange geometry remaining fixed.

FIG. 8 illustrates a converging geometry in the fluid conduit at the heat exchange region wherein the septum face 60 is angled at angle $\theta$ in the direction of liquid flow 62. The geometry of the septum face 60 may also diverge or be a complex curve containing both converging and diverging elements, i.e., a concave or convex arc. The geometry shown illustrates a modified septum. In some cases, it may be desirable to modify the geometry of the anode heat exchange surface 63 in like manner. An example would be the embodiment depicted in FIG. 5 wherein the swirl flow geometry could be enhanced by a diverging anode geometry which would use a component of centrifugal force to optimize further the swirl flow characteristics. Additional improvement may be obtained by designing for optimum spacing geometry between inside anode input face 22 and septum input face 23, generally indicated as 64. To maintain constant liquid velocity, a constant cross-section is required. Thus, input face spacing 64 would decrease as liquid flow 62 approached the anode strip 65. In general, spacing geometry between the output faces of the septum 66 and anode 67 is not critical to the heat exchange process and may be optimized for parameters such as strength or minimizing back pressure.

Referring again to FIG. 1, a further design consideration (raised by passing the cooled coolant between inner tube 6 and outer rotatable shaft 2) is then undesirable rotationable velocity in the direction of anode rotation imparted to a thin layer of coolant adjacent the inside diameter of the rotatable shaft 2 as it travels toward the anode and up the anode face 22.

Figure 9:
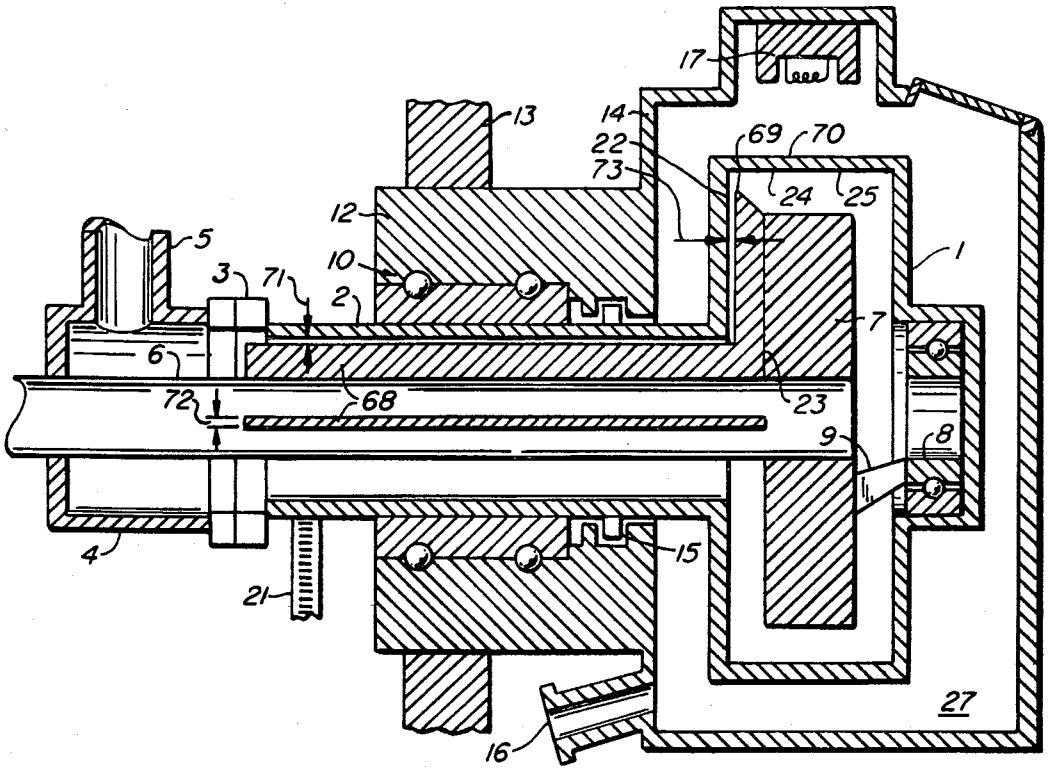
FIG. 9 is a complete cross-sectional view of a rotating anode x-ray tube incorporating baffle fins in the coolant input conduit so as to minimize induced rotational velocity in coolant flow.

Only a thin layer of liquid has a rotatable velocity imparted to it, and it substantially mixes with the main body of flow. Thus, only a minor rotation of the total liquid stream by the time it reaches the anode surface is created. However, this rotational velocity is undesirable because it reduces the relative velocity between the anode and the coolant. A coolant rotational velocity can be minimized by two structures. The first, as illustrated in FIG. 9, utilizes thin fins 68 mounted longitudinally on the outer diameter of inner tube 6. Fins 68 extend from rotatable coolant seal 3 to a point at 69 just before anode heat exchange surface 70. Fins 68 are maintained in close proximity (a distance generally indicated as 71) to the inner diameter of rotatable shaft 2, and in close proximity (a distance generally indicated as 73) of inner anode face 22.

Figure 10:
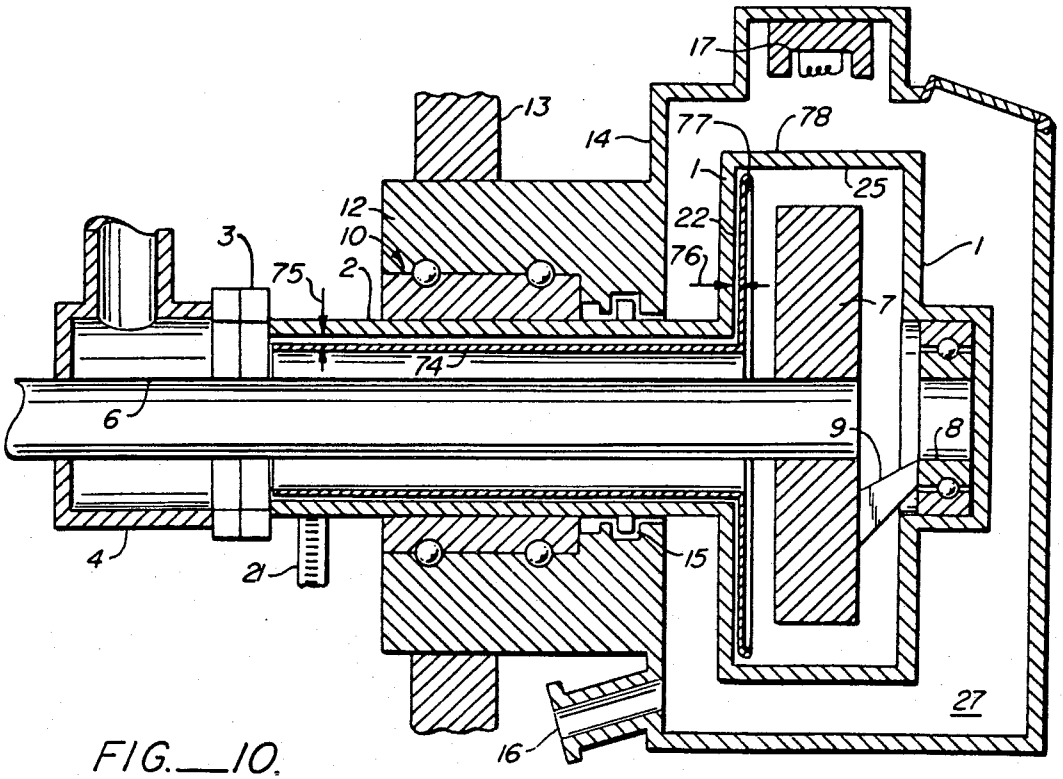
FIG. 10 is a complete cross-sectional view of a rotating anode x-ray tube incorporating a stationary outer tube so as to minimize induced rotational velocity in coolant flow.

A second method of minimizing induced rotational flow in the coolant (shown in FIG. 10) is by providing a thin walled stationary outer tube 74, extending from the rotatable coolant seal 3 into the anode 1, in close proximity (a distance generally indicated as 75) to the inner diameter of rotatable shaft 2, and maintaining close proximity (distance generally indicated as 76) to anode face 22, terminating at point 77 just prior to anode strip 78. (The radial support fins are not shown.)

Thus, in both structures, the incoming cooled coolant is substantially separated from rotationally-induced motion imparted by rotational shaft 2 and anode face 22, or rotational components are damped out. Once past the heated anode surface, induced rotational velocity in the coolant is no longer relevant to the heat exchange process. To further isolate thermally the incoming coolant from the outgoing heated coolant, inner stationary tube 6 (FIG. 1) may be constructed from two thin walled tubes. These two tubes, whose diameters are such to provide a small gap between them, are concentrically and hermetically brazed at each end in a vacuum. Thus, the evacuated space between the tubes provides insulation as with a "thermos" jug.

Figure 11:
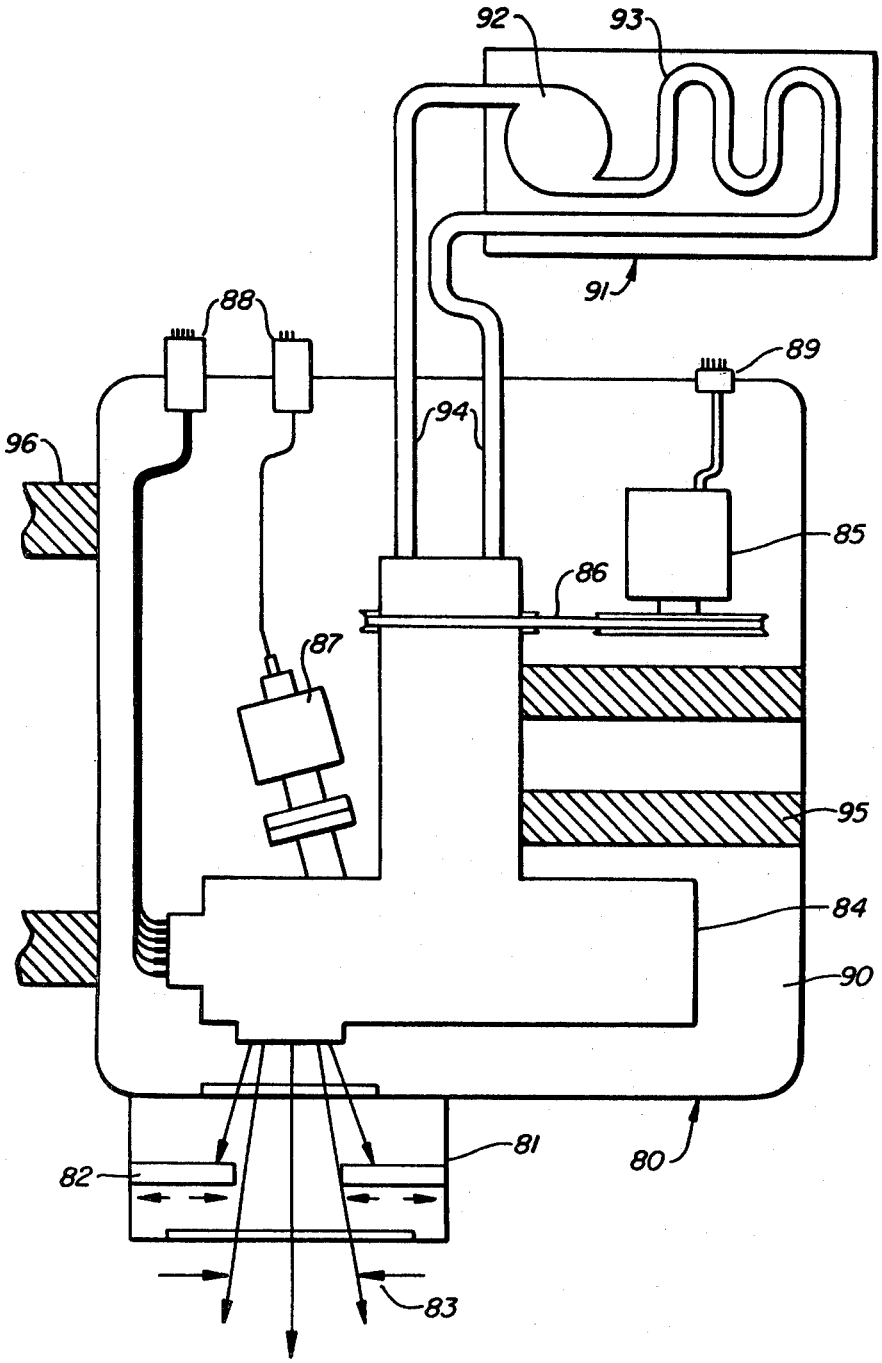
FIG. 11 is an x-ray tube assembly containing the essential elements that are required for the functioning and use of a liquid cooled rotating anode x-ray tube.

The liquid cooled rotating anode x-ray tube is mounted within an x-ray tube assembly. Such an x-ray tube assembly, shown in FIG. 11, typically comprises the following elements: an x-ray tube housing 80 which is generally made from an x-ray absorbing material; an x-ray beam limiting device 81, commonly called a collimator; a liquid cooled rotating anode x-ray tube 84, as previously described; a motor 85 and a drive belt 86, or other means for rotating the anode at the desired rpm. Collimator 81 may contain movable shutters 82 to permit a variable x-ray field size 83 to be obtained. A vacuum pump 87 is mounted on or within the x-ray tube vacuum envelope to maintain the required vacuum. Vacuum pumping means that may be used include, for example, getters or Vac-Ion, titanium sublimation, cryogenic, diffusion or turbomolecular pumps. These pumps may be used alone or in combination. High 88 and low 89 voltage cables and connectors are utilized as required. A suitable high voltage isolation medium 90 is required within the x-ray tube housing 80 to prevent arc-over from high volrage surfaces on the x-ray tube to the grounded housing. A suitable medium 90 may be a gas such as a greon or sulphur hexafluoride or a liquid such as a fluorocarbon, a silicone oil or a transformer oil. A vacuum may also be used as an insulating medium or selected regions may be potted with solid dielectrics such as epoxy or silicone. The above illustrative insulating means may be used alone or in combination. A heat exchanger 31 is required if the coolant system is to be of the closed loop type. Generally, the heat exchanger contains a pump 92 for circulating the coolant fluid and heat exchange means 93 to transfer the heat to a secondary medium. The secondary medium is suitably air for an air-cooled system and water for a water-cooled system. Suitable couplings and hoses 94 are utilized if the heat exchanger is external to the x-ray tube assembly. Mounting elements 95 for the x-ray tube within the x-ray tube housing are also provided. These mounting elements are suitably formed of dielectric materials such as ceramic or plastic for high voltage isolation. External mounting means 96 are also provided for mounting the x-ray tube assembly in the desired systems configuration.

It should be appreciated that the foregoing describes a particularly advantageous liquid cooled rotating anode x-ray tube and the assembly which is suitable for use in applications that require the continuous duty generation of x-rays at high power levels. This includes high voltage x-rays for medical diagnostic use or low voltage x-rays for applications such as lithography.

The contoured surface technique herein described can be applied to other geometries of rotating anode and fixed target tubes. Examples of fixed target (anode) tubes include x-ray tubes; R.F. tubes such as Klystrons, Traveling Wave Tubes and Magnetrons and, power beam tubes such as diodes, triodes, tetrodes, pentodes and other similar devices. The anodes to be described are generally hollow and of generally thin wall construction with the inside surface receiving the energy beam and the corresponding exterior surface, which is in contact with a flowing liquid coolant, being the heat exchange surface. The heat exchange region generally extends several wall thicknesses beyond the underlying surface receiving the energy beam. These structures are generally circular symmetric about their central axis. Preferred embodiments include the use of curved surfaces, in accordance with the present invention, on the anode heat exchange surface such that the curve on the anode heat exchange surface, the origin of said curve, and the central axis of the structure lie in the same plane, said plane being any one of an infinite number of planes that may be obtained by rotating said plane about the central axis of the structure. Also, while in the heat exchange region, the velocity vector of the liquid coolant flow should also lie in the above described plane. Any component of circumferential velocity of the liquid around the central axis of the anode is undesirable and results in a centrifugal force, wherein the pressure increases with increasing radial distance from the anode heat exchange surface, thus reducing heat transfer and lowering burn out heat flux. The external anode triode of FIG. 14 best illustrates the above. The central axis 123 of the anode 128 and the central axis 123 of the cathode 122 and grid 124 are coincident. The inner electron beam impinging on surface 152 and the outer heat exchange surface 143 of the anode 126 are circular symmetric about central axis (centerline) 123. The flow diverter surface 146 of coolant jacket 128 is also generally circular symmetric about central axis 123. The liquid velocity vector 131 in the anode heat exchange region 150 lies in the plane described by the central axis 123, the curve 143 and its origin 145. As can be seen, the same center line may be drawn in FIGS. 12, 15 and 16 resulting in the same anode and diverter symmetry as was described for FIG. 14. For example, to provide for efficient cooling of the anode heat exchange surface, the heat exchange surface is contoured such that the liquid flow interacting with the contoured surface generates a pressure gradient having a component perpendicular to the anode heat exchange surface. That is, the pressure increases with decreasing radial position. Alternatively, a calculated surface roughness (geometry) may be applied to the liquid cooled anode heat exchange surface as previously described for the liquid cooled rotating target x-ray tube. Both techniques may be used. The applications of the design criteria can best be illustrated by reference to an example.

Maldonado et al, J. Vac. Sci. Technol., 16 (6) Nov./-Dec. 1979, describe a stationary target (hereinafter called an anode) x-ray tube. The anode is described as a cone with a wall thickness of 0.6 mm and is provided with a water diverter to provide uniform average water velocity on the back (outside) surface of the cone. A flow of water approaches the cone tip substantially parallel to the central axis of the cone. Constant conduit cross section and resulting constant velocity of the water is obtained by varying the spacing between the back of the cone and the water diverter. A pressure drop of approximately 85 psi is required to obtain the stated velocity of $10^4$ cm/sec (330 ft/sec) along the heat exchange surface of the anode. This very high velocity is required to obtain efficient heat transfer, i.e., the rapid removal of nucleate bubbles under the conditions of substantially liner flow.

In this example, a flow of 4 gal/min is used for 4 kw input power though less than 1% of the water actually boils, i.e., 0.2 gal/sec). The high power dissipation, 12 kw/cm$^2$, is achieved by the use of the very high velocity cooling water along the anode surface coupled with the initial pressure gradient perpendicular to the anode surface, generated at the cone tip region, and progressing some distance up the side, by the water flow as it is diverted outwardly by the cone geometry. Though little water is boiled, a high Reynolds number is required to obtain a high cooling efficiency. It can be seen that the change in direction, i.e., divergence, of the water flow as it strikes the tip of the cone and the continuing divergence of different layers of water some distance up the surface of the cone will create a pressure gradient perpendicular to the anode heat exchange surface due to inertia forces.

This is the same principle, but different structure, as the previously-described Kussel et al and Philips devices. However, at some point past the tip of the cone, the path of the water flow becomes substantially linear along the surface of the cone, i.e., no further pressure gradients of substance are generated perpendicular to the surface of the anode heat exchange surface. At this point, the maximum heat flux becomes determined by the linear coolant flow characteristics. The higher heat flux possible in the region where a gradient is present cannot be utilized, thus the transition from a flow wherein a pressure gradient perpendicular to the that surface has been established to one where the flow is linear, i.e., a perpendicular gradient is no longer present, as occurs in the described conical anode, limits the maximum heat flux (burn out) to the lowest value determined by the linear coolant flow.

Maximum heat flux can be obtained from the conical anode in accordance with one aspect of the present invention by providing the outside surface of the cone along the heat exchange region in the form of a diverging curve. The diverging curve, its origin and the axis of the anode lie in the same plane thus providing rotational symmetry i.e. the anode has the same curve around its circumference. The constantly changing path of coolant flow generates a pressure gradient perpendicular to the anode heat exchange surface thereby maximizing heat flux. The curve suitably is in a shape similar to a Tractrix, Hyprocycloid, ellipse, or some other curve that generates similar shapes, rotated about the Y axis as shown in Granville et al, Elements of Calculus, Ginn & Co., 1946, pp. 528, 532. The shape of the water diverter would also change from a conical surface to a curved one in order to maintain the constant cross section. Such an anode target assembly is shown in FIG. 12.

Figure 12:
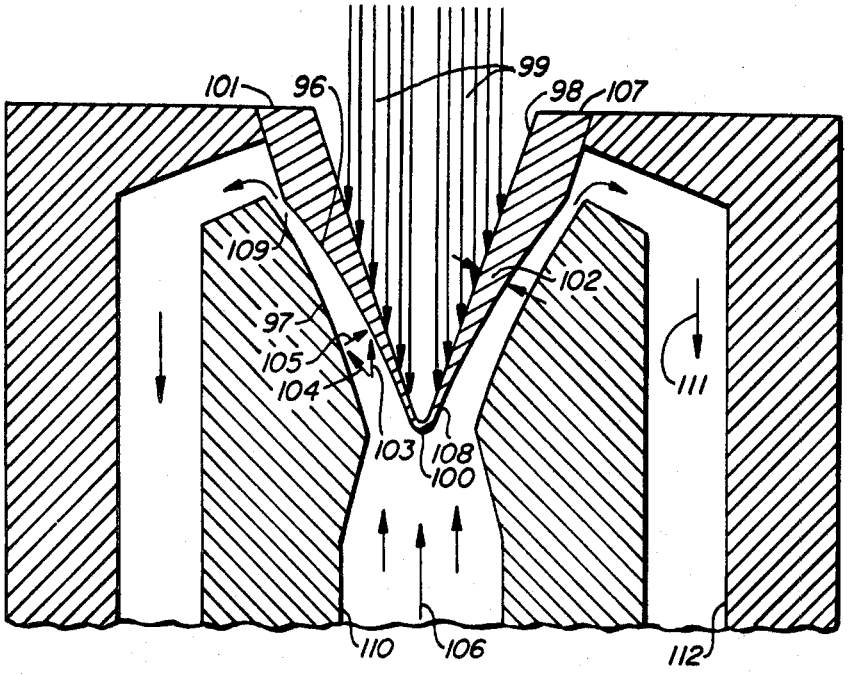
FIG. 12 is a cross-sectional view of a stationary anode utilizing the present invention.

Referring now to FIG. 12, the conical outside surface of the anode is replaced with a curved surface 96. The shape of the water diverter 97 is also curved and in such manner as to maintain the constant conduit cross section specified by Maldonado. The inner surface 98 of the anode remains cone shaped to maintain a constant electron beam 99 power density striking the anode surface. The hollow circular electron beam 99 described by Maldonado is shown. The conical inner surface 98 and the curved diverging outer surface 96 of the anode result in an increasing anode wall; thickness 102 as one progresses from the apex 100 to the base 101 of the "cone". If it were desired to obtain a uniform anode wall thickness, the inner surface 98 of the anode would conform in shape, i.e., curvature, to the outer curve 96. Vector 103 illustrates the direction of water flow, already somewhat outwardly diverged from its initial path. Vector component 104 shows the velocity component tangent to the curved anode heat exchange surface. It is velocity component 105 that creates the pressure gradient perpendicular to the anode surface. The gradient may be increased by increasing the rate of curvature of anode surface 96 or by increasing the velocity of the liquid coolant 106. The $10^4$ cm/sec water velocity described by Maldonado is very high and therefore only a small curvature of the anode surface 96 is required to generate an appreciable gradient. The anode heat exchange surface is the surface of the portion of anode 107 beginning slightly above the apex 108 of the anode and within the diverter, to just before the end of the diverter at point 109 on the anode surface towards the base of the anode 107. The diverter structure 110 serves to separate incoming water 106 from outgoing water 111 as well as to provide the proper conduit geometry in the anode heat exchange region. The anode holder 112 forms the outer jacket for the exiting water 111.

Electron beam power density considerations may dictate that the inside surface, i.e., the water cooled anode heat exchange surface, is provided with the diverging curve. Therefore, the stated anode wall thickness, 0.6 mm, must vary in some manner. For example, the wall thickness at the cone tip may start thinner, i.e., as thin as 0.25 mm (0.010") and then get progressively thicker to some maximum thickness, possibly about 1 mm (0.040") towards the base of the cone. The minimum and maximum permissible wall thickness will be dictated by the properties of the anode metal, coolant conduit geometry, characteristics of the coolant liquid and its velocity, desired power densities, etc. Inasmuch as the described conical anode is already quite efficient from a heat exchange standpoint, and this is principally due to the very high water velocity, i.e., high Reynolds number, the improvements from the present invention may reside more from the reduced probability of destructive film boiling, alluded to in the article, and/or a reduced pressure required, presently 165 psi, rather than from any increased power that may be realized. Alternatively, it may enable the use of a dielectric coolant, such as a fluorocarabon or a silicone oil, instead of water. This eliminates the corrosion problems associated with water and, more importantly, enables the anode to operate at high voltage which permits designs which substantially eliminates the destructive heating effects of secondary electrons on the x-ray window and other parts of the tube.

Another example of the application of the present invention to fixed target tubes is in beam power tubes such as diodes, triodes, tetrodes pentodes and other similar devices.

Figure 14:
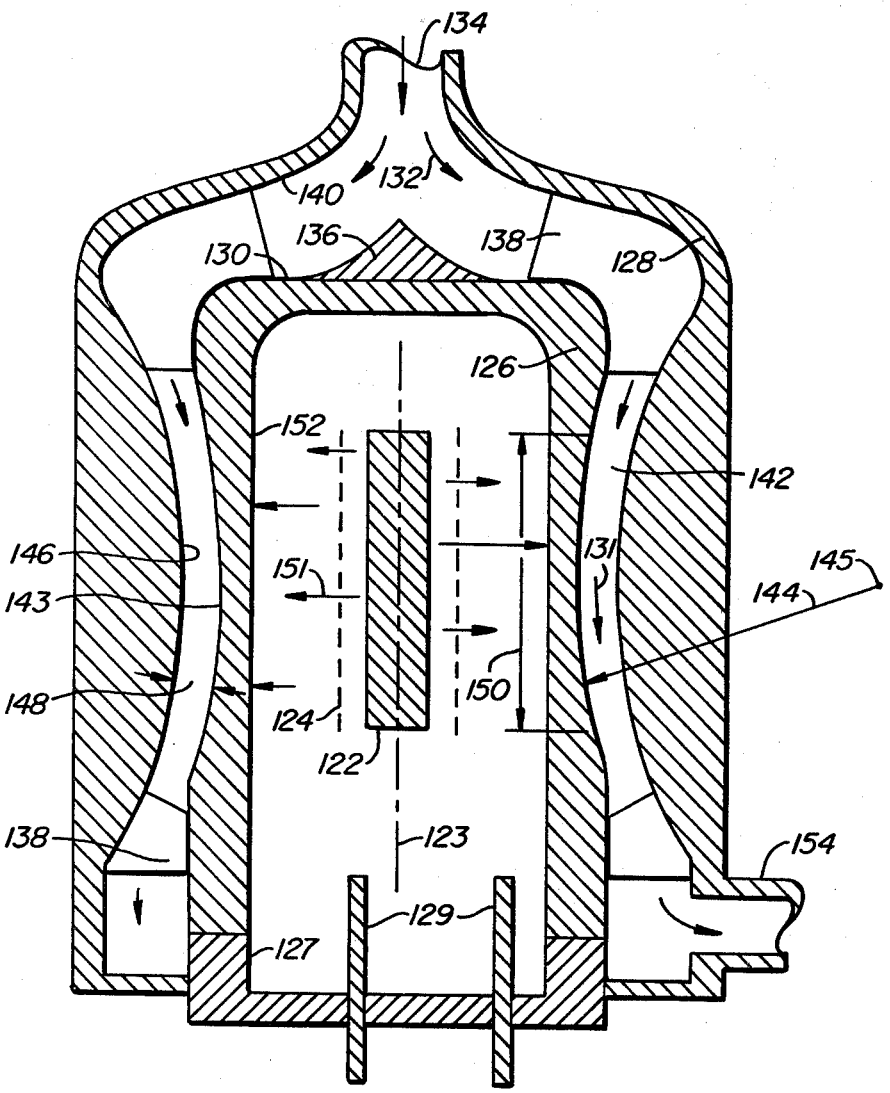
FIG. 14 is a cross sectional view of a high powered external anode triode.

FIG. 14 illustrates an external anode high power triode, with diodes, tetrodes and pentodes being identical except for the number of grids incorporated. Shown is the common concentric cylindrical construction. The cathode 122 is mounted within grid 124 which in turn are mounted within the cup shaped anode 126. Anode 126 is sealed in vacuum tight relationship to tube base 127. Electrical connections are made to the cathode 122 and grid 124 through pins 129.

Coolant jacket 128 serves to confine and direct the flow of liquid coolant around the outside surface 130 of anode 126. Coolant liquid 132 enters coolant jacket 128 through oriface 134 and is directed along the exterior surface of the anode. Diverter 136 serves to maintain a smooth flow of liquid and thus minimize undesirable liquid flow effects such as cavitation which reduce cooling efficiency. Fins 138 are disposed radially between the coolant jacket 128 and the anode 126 terminating just before anode heat exchange surface 143 to assure parallel flow of the liquid coolant and inhibit undesirable liquid flow characteristics acting much the same as radially disposed fins 68 of FIG. 9 which also terminate 69 just prior to the anode heat exchange surface 24 and, said fins 138 of FIG. 14 also provide precision alignment both radial and axial, between the inside diverter surface 146 of the coolant jacket 128 and the heat exchange surface 143 of the anode 126. The coolant liquid passes through the conduit 142 and then flows out exit port 154

The curved anode surface 143 which is generated by radius 144 of curvature from origin 145, which has been machined into the outside surface of the cylindrical anode 126 and around its circumference. The curved surface of 143 follows much the same design criteria of a single period of curved surface 43 of FIG. 4 which is defined by radius 44. The principle difference being that the high relative anode-coolant velocity is obtained by a rotating anode and slow moving liquid in FIG. 4 whereas a high liquid velocity and stationary anode are utilized in FIG. 14. The maximum half angle $\alpha$ which is 20°, or a total maximum of 40° for entering and exiting liquid over each period of the curve, for FIG. 4, in general also applies to FIG. 14, however because FIG. 14 possess one cycle of the curved surface 43, FIG. 4, the angle $\beta$ of FIG. 14, which corresponds to the angle $\alpha$ of FIG. 4 may be somewhat larger. An angle that is too large i.e., in excess of 60°, will result in a diminished liquid coolant flow rate, that is, a large pressure drop in the direction of flow in the heat transfer region at the curved surface, and is undesirable. Curves other than an arc of a circle may be used such as those described for FIG. 12. The choice of curves other than circular enables a variable force with corresponding variable heat transfer to be obtained at the anode heat exchange surface because of the variable radius of curvature. This helps to compensate for variable heat flux in the anode as might be occasioned by beam focusing or beam bunching.

The curved diverter surface 146, FIG. 14, on the coolant jacket for the triode is approximately the same as the curved diverter surface 97, FIG. 12 used in conjunction with the conical x-ray tube anode. All the same design criteria apply. The spacing 148 between diverter surface 146 and anode heat exchange 143 is also maintained such that an approximately constant cross sectional area is maintained over the length of the anode heat exchange surface 150 thus maintaining approximately constant velocity liquid flow. However, it may be desirable to vary the cross section of conduit 142 and thus vary the liquid velocity which in turn varies the pressure gradient perpendicular to the anode heat exchange surface and consequently the heat exchange rate. The calculated surface roughness, as described for the rotating anode may be added to the anode heat exchange surface to break up the viscous sublayer and enhance nucleate boiling.

Cathode 122 emits an electron stream 151 radially outward toward the anode inner surface 152 after being modulated by grid 124. Upon striking the anode surface 152, heat is generated and is transmitted through the anode wall to the heat exchange surface 143. Heat transfer at the liquid-anode heat exchange surface then takes place in accordance with the principles of the present invention as previously described for the conical anode in FIG. 12 and the various rotating anode structures.

A further example of fixed target tubes are R.F. tubes such as Klystrons, Traveling Wave Tubes and magnetrons. Klystrons and Traveling Wave Tubes are generally linear beam devices wherein the electron beam from an electron gun is focused to travel in a straight line past an interacting RF circuit and thence into an anode for dissipation.

Figure 15:
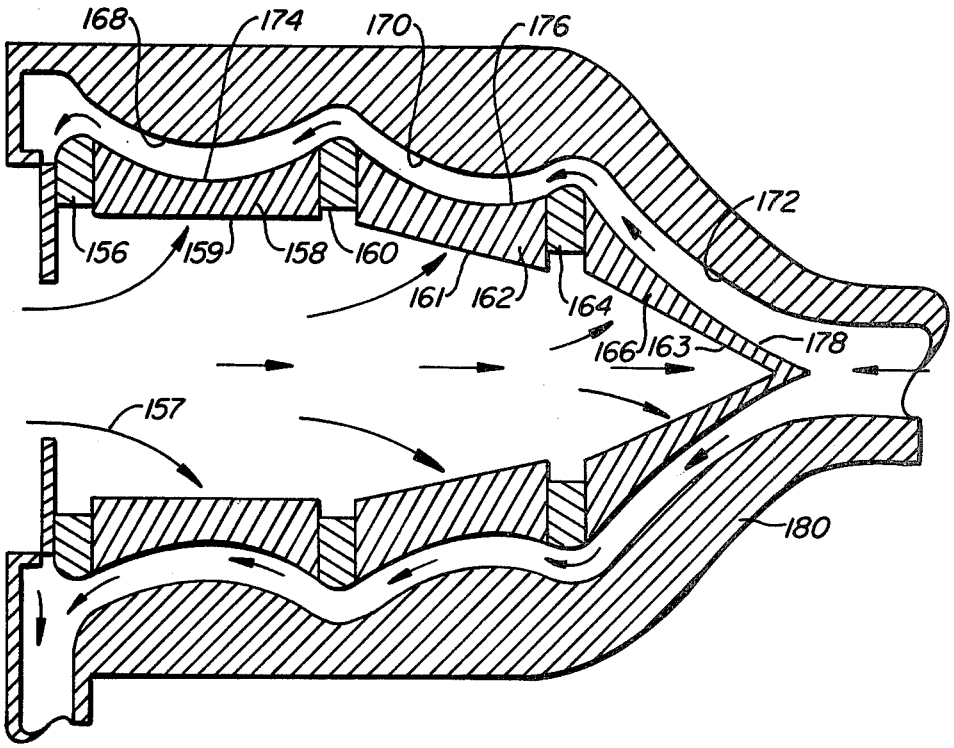
FIG. 15 is a cross sectional view of a three stage depressed collector as might be used with high powered Klystrons or TWT's.

FIG. 15 illustrates a three stage depressed anode, sometimes called collector, composed of three segments 158, 162, and 166, joined in vacuum tight relationship as might be used with a Klystron or Traveling Wave Tube to improve operating efficiency. Insulator 156, such as a ceramic ring, isolates the generally cylindrical first stage 158 of the anode from the RF body so that it may be set at a voltage lower than that of the RF body. A second insulator 160 electrically isolates the second stage 162 of the anode, which is generally shown in the form of a truncated cone. It may be set at a further reduced voltage. A third insulator 164 isolates the final segment 166 of the anode which is generally in the form of a cone. It may be set at a yet further reduced voltage. The outside diameter of the insulators are shaped so as to conform to the desired curves in the anode heat exchange region. The three anode segments 158, 162 and 166 and the insulators 156, 160 and 164 are joined in vacuum tight relationship together and to the RF body. As can be readily seen, the first stage 158 of the anode and its associated liquid diverter 168 are substantially identical to the anode 126 and its liquid diverter 146 in FIG. 14 except that the anode segment 158 is open at both ends. The third segment 166 of the anode and its diverter 172 are substantially identical to the conical anode 102 and its diverter 97 of FIG. 12. The second anode segment generally in the form of a truncated cone 162 and its diverter 170 are a modified version of the anode cone and diverter of FIG. 12.

Electron beam 157 enters the anode and diverges to strike the inside surfaces 159, 161 and 163 of respective anode segments 158, 162 and 166. The heat thus generated is transmitted to the respective curved anode heat exchange surfaces 174, 176 and 178, the curves, their origins and the axis of the anode lying in the same plane thereby providing rotational symmetry. Heat transfer then takes place in accordance with the principles of the present invention as previously set forth. In all three anode design segments, the same design criteria for the anode heat exchange surface would apply. The inside surfaces of the various anode segments are generally described as linear, but may be curved as was described for the conical target of FIG. 12. Because of the high cooling efficiency of the present invention, dielectric cooling liquids, as previously described, may be used. The insulating properties of the dielectric liquids permit the various anode segments to be in close proximity to each other thus enabling optimum mechanical and electrical designs to be achieved in terms of heat transfer (i.e. thinner walls), electrical leakage between elements, compactness etc. With the above design, a common conduit of dielectric coolant flow, as shown, can be utilized for all segments of the anode. The coolant jacket 180 which contains diverter surfaces 168, 170 and 172 may be a single structure as shown or assembled from several structures for ease of fabrication.

Figure 16:
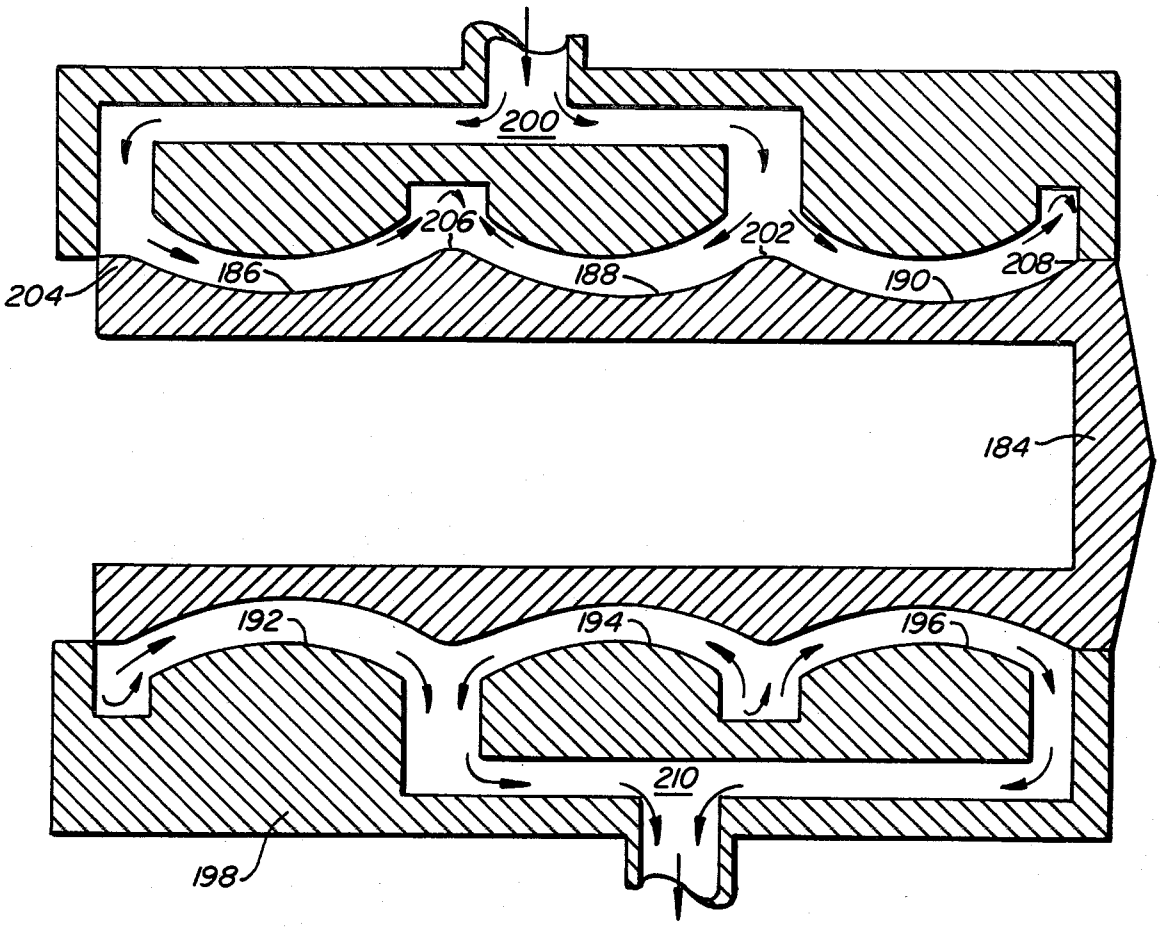
FIG. 16 is a cross sectional view of an anode with multiple periods of cooling surfaces, each period alternately serving as an inlet and outlet for the cooling liquid.

An alternative method of cooling a multi-period curved anode surface such as shown in FIG. 15 is to provide alternate input and output liquid ducts at the beginning of each period. This in effect trades a lower pressure drop for increased liquid volume and may have special benefits in super power triodes and Klystrons. The anode of FIG. 16 illustrates an anode with multiple periods and alternate input and output ducts for each period of the curves on the anode heat exchange surface. Anode 184 has flutes with rounded cusp heat exchange surfaces 186, 188 and 190 designed in accordance with the present invention and whose curvature generally corresponds with the flutes 43 and cusps 45 of FIG. 4. Diverter surfaces 192, 194 and 196 of coolant jacket 198 serve to direct the liquid coolant flow in proper relationship with the anode heat exchange surfaces 186, 188 and 190. Coolant input duct 200 directs coolant flow to alternate cusps 202 and 204. The coolant then flows along the several heat exchange surfaces 186, 188, and 190 to cusps 206 and 208 and thence out exit duct 210 to an external heat exchanger (not shown). Thus, it is seen that FIG. 15 illustrates a periodic curved heat exchange surface with the liquid flow being in series over the several segments whereas FIG. 16 illustrates a parallel flow arrangement.

In this type of structure, the x-ray window and selected regions of the vacuum envelope would operate at ground potential, the cathode assembly would be above ground potential, and the anode would operate at the desired potential above the cathode.

Thus, the target window and other heat sensitive x-x-ray tube elements operating at ground potential would reflect secondary and reflected primary electrons thereby avoiding any heating conical surface, a relatively uniform field intensity can be achieved over a reasonable field size for use in lithography. As one proceeds off axis, as the field intensity drops from one side of the cone because of the smaller angle relative to the target surface, however, the field intensity is substantially compensated for by an increase in intensity from the opposite side of the cone where the angle is increasing.

This technique, while only valid for small changes in angle, is quite effective. a geometry that would partially accomplish the same effect for a rotating anode would be to provide a "V" groove in the anode corresponding to the electron beam track. Thus, along an axis at right angles to the groove, an effect similar to that of the conical shape of the fixed target would be achieved. As the intensity is measured off axis from the center of the groove, the opposite surface would tend to compensate for the decrease due to a smaller target angle. However, along an axis parallel to the groove, compensation would be substantially absent.

Figure 13:
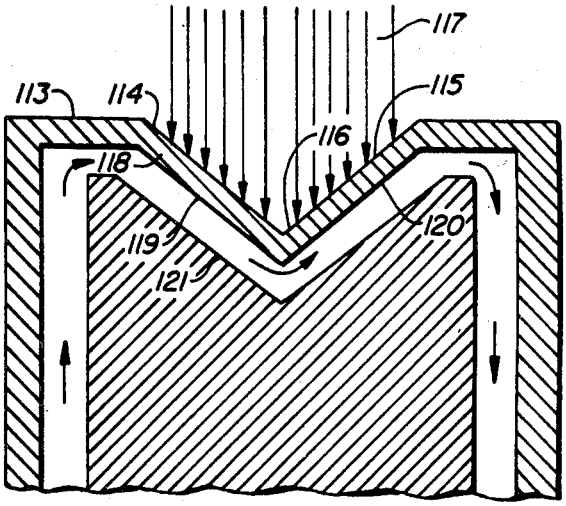
FIG. 13 is a cross-sectional view of a high power uniform intensity x-ray tube utilizing the present invention.

FIG. 13 illustrates a "V" groove rotating anode configuration. The rotating anode 113 has a "V" groove 114 machined along its periphery. The vacuum side of the "V" groove 114 provides the inclined surface for the electron beam track 115. The apex 116 of the "V" groove is not irradiated by the electron beam 117 because of poorer heat transfer characteristics. While anode wall 118 is shown having a uniform thickness, the anode wall thickness 118 can be made variable to optimize heat transfer. The liquid cooler anode heat exchange surface on the incoming face 119 and the outgoing face 120 of the "V" groove is provided with a contoured surface or a calculated surface roughness, or a combination of a contoured surface and a calculated surface roughness. Incoming liquid cooled "V" groove surface 119 may have a different contoured surface or calculated surface roughness, or a combination thereof, than that on outgoing liquid cooled "V" groove surface 120 to further optimize performance. Septum 12 is contoured with respect to the liquid cooled side of the "V" groove so as to provide the desired conduit geometry.

It will be understood that the above description is of preferred exemplary embodiments of the present invention and that the invention is not limited to the specific forms shown. Modification may be made in the design and arrangement of the elements without departing from the spirit of the invention as expressed in the appended claims.

I claim:

1. In apparatus of the type including a stationary anode adapted for irradiation by an energy beam, and including a heat exchange surface said apparatus including means for providing a flow of coolant liquid to remove heat from said heat exchange surface by formation of nucleate vapor bubbles on said heat exchange surface, said liquid tending to include a viscous sublayer adjacent to said heat exchange surface, the improvement wherein said heat exchange surface includes means, disposed on said heat exchange surface, for forming nucleate bubbles of predetermined size and distribution to thereby increase heat flux.

2. In apparatus of claim 1 the further improvement wherein said anode heat exchange surface has intimately adherent thereto a thin porous metal layer.

3. In the apparatus of claim 2 the further improvement wherein said porous metal is of relatively uniform pore size.

4. In the apparatus of claim 1 the further improvement wherein said means for the efficient formation of nucleate bubbles comprises cavities of predetermined geometry and distribution created in said anode heat exchange surface, said cavities being spaced apart such that a maximum power dissipation the nucleate bubbles formed at said cavities do not coalesce to form an insulating vapor blanket.

5. In the apparatus of claim 4 the further improvement wherein said cavities on the anode heat exchange surface are of predetermined geometry to provide an optimum formation of nucleate bubbles.

6. In apparatus of the type including a stationary anode adapted for irradiation by an energy beam, and including a heat exchange surface, said apparatus including means for providing a flow of coolant liquid to remove heat from said heat exchange surface by formation of nucleate vapor bubbles on and removal from said heat exchange surface, said liquid tending to include a viscous sublayer adjacent to said heat exchange surface, the improvement wherein said heat exchange surface includes means disposed thereon for breaking up said viscous sublayer to promote removal of said nucleate bubbles.

7. In the apparatus of claim 6 the improvement wherein said means for breaking up said viscous sublayer comprises roughness elements formed on said heat exchange surface projecting into said liquid.

8. In the apparatus of claim 6, the further improvement wherein the apparatus comprises means for generating pressure gradients in said liquid having a component perpendicular to said heat exchange surface without substantially impeding the relative velocity between the anode heat exchange surface and said liquid, said component having a magnitude directly proportional to the relative velocity squared between said anode heat exchange surface and said liquid.

9. In the apparatus of claim 8 the improvement wherein said means for breaking up said viscous sublayer comprises roughness elements formed on said heat exchange surface projecting into said liquid.

10. In the apparatus of claim 8 the further improvement wherein said anode heat exchange surface has intimately adherent thereto a thin porous metal layer.

11. In the apparatus of claim 8 the improvement wherein said means for generating pressure gradients comprises said heat exchange surface and said heat exchange surface comprises a contoured surface having a predetermined periodic geometry.

12. In the apparatus of claims 11 the further improvement wherein each said period or curve is provided with ducting for the alternate injection and removal of said coolant.

13. In the apparatus of claim 12 wherein said predetermined periodic geometry comprises flutes with rounded cusps.

14. In the apparatus of claim 6 the further improvement wherein said anode heat exchange surface has intimately adherent thereto a thin porous metal layer.

15. In apparatus of the type including a stationary anode adapted for irradiation by an energy beam along a first portion thereof, and including a heat exchange surface generally overlying and at least generally coextensive with said anode first portion, said apparatus includes means for providing a flow of coolant liquid to remove heat from said heat exchange surface by formation of nucleate vapor bubbles on said heat exchange surface and removal of said nucleate bubbles from said heat exchange surface, the improvement wherein:

said apparatus includes means for generating pressure gradients in said liquid having a component perpendicular to said heat exchange surface along substantially the entirety of said heat exchange surface without substantially impeding the relative velocity between the anode heat exchange surface and said liquid, said component having a magnitude directly proportional to the relative velocity squared between said anode heat exchange surface and said liquid, to promote removal of said nucleate vapor bubbles from said heat exchange surface.

16. In the apparatus of claim 15 the improvement wherein said means for generating pressure gradients comprises said heat exchange surface and said heat exchange surface comprises a contoured surface having a predetermined periodic geometry.

17. In the apparatus of claim 15 wherein said liquid tends to include a viscous sublayer adjacent to said heat exchange surface, the further improvement wherein said heat exchange surface includes means for breaking up said viscous sublayer.

18. In the apparatus of claim 17 the improvement wherein said means for breaking up said viscous sublayer comprises roughness elements formed on said heat exchange surface projecting into said liquid.

19. In the apparatus of claim 17 the improvement wherein said means for generating pressure gradients comprises said heat exchange surface and said heat exchange surface comprises a coutoured surface having a predetermined periodic geometry.

20. In the apparatus of claim 17 the further improvement wherein said anode heat exchange surface has intimately adherent thereto a thin porous metal layer.

21. A liquid cooled stationary anode tube comprising:

a. a vacuum envelope;

b. an electron source enclosed within said vacuum envelope said electron source oriented such that the electron beam emitted from said electron source impinges on a predetermined region of the anode;

c. a stationary anode assembly and means for effective liquid cooling of said anode at a heat exchange surface;

d. means for the efficient removal of heat from the liquid cooled anode heat exchange surface of said anode, said means comprising a contoured surface of the anode heat exchange surface for developing a pressure gradient having a component perpendicular to said heat exchange surface without substantially impeding the relative velocity between the anode heat exchange surface and said liquid, said component having a magnitude directly proportional to the square of the relative velocity between said anode heat exchange surface and said liquid, to facilitate removal of said nucleate bubbles.

22. A liquid cooled stationary anode tube as described in claim 21 wherein said coolant liquid flow includes viscous and transition layers and said contoured surface is further prepared with a calculated surface roughness such that the roughness height is no less than about 0.3 thickness of the viscous sublayer and no greater than about the combined thickness of the viscous sublayer and transition zone.

23. A liquid cooled stationary anode tube as described in claim 21 wherein said anode is generally cone shaped, and wherein said contoured surface of the outer surface of said conical shape is a diverging curve wherein said curve, its origin and the axis of said anode lie in the same plane, ingoing from the apex to the base, and the inner surface of said anode is conical, thereby resulting in a variable anode wall thickness, said anode wall thickness being thinnest at the apex and thickest towards the base of the conical-type shape, the inner conical surface being where the electron beam impinges and the outer curved surface being where the electron beam impinges and the outer curved surface being the anode heat exchange surface, and wherein a liquid coolant diverter is structured in the anode heat exchange region to provide predetermined liquid flow conditions.

24. A liquid cooled stationary anode tube as described in claim 23 wherein said inner conical surface is now curved to match the outer curved surface such that a constant anode wall thickness results.

25. A liquid stationary anode tube as described in claim 24 wherein the liquid cooled anode heat exchange region is further prepared with a calculated surface roughness whose height is no less than 0.3 that of the coolant liquid viscous sublayer and no greater than the combined thickness of the coolant liquid viscous sublayer and the transition zone.

26. A liquid cooled stationary anode tube as described in claim 23 wherein the liquid cooled anode heat exchange region is further prepared with a calculated surface roughness whose height is no less than 0.3 that of the coolant liquid viscous sublayer and no greater than the combined thickness of the coolant liquid viscous sublayer and the transition zone.

27. A liquid cooled stationary anode tube as described in claim 23 wherein said inner conical surface is curved such that the curve is intermediate between a conical surface and the curve of the outer surface, resulting in an anode wall thickness no greater than that resulting from an inner conical wall described in claim 23 and no less than that resulting from a curved surface that matches the outer surface and that yields a constant wall thickness.

28. A liquid cooled stationary anode tube as described in claim 27 wherein the liquid cooled anode heat exchange region is further prepared with a calculated surface roughness whose height is no less than 0.3 that of the coolant liquid viscous sublayer and no greater than the combined thickness of the coolant liquid viscous sublayer and the transition zone.

29. An apparatus as described in claim 23 wherein means are provided in the proximity of, but not extending into, the anode heat exchange region to insure that the liquid velocity vector lies generally in the plane containing the axis of said anode.

30. A liquid cooled stationary anode tube as described in claim 21 wherein said anode is generally cylindrical shaped, and wherein said contoured surface of the outer surface of said cylindrical shape is a concave curve wherein said curve its origin and the axis of said anode lie in the same plane and the inner surface of said anode is cylindrical, thereby resulting in a variable anode wall thickness, said anode wall thickness being thinnest at the enter of said curve and thickest toward each end of said curve, the inner cylindrical surface being where the electron beam impinges and the outer curved surface being the anode heat exchange surface, and wherein a liquid coolant diverter is structured in the anode heat exchange region to provide predetermined liquid flow conditions.

31. A liquid cooled stationary anode tube as described in claim 30 wherein said inner cylindrical surface is now curved to match the outer curved surface such that a constant anode wall thickness results.

32. A liquid cooled stationary anode tube as described in claim 31 wherein the liquid cooled anode heat exchange region is further prepared with a calculated surface roughness whose height is no less than 0.3 that of the coolant liquid viscous sublayer and no greater than the combined thickness of the coolant liquid viscous sublayer and the transition zone.

33. A liquid cooled stationary anode tube as described in claim 30 wherein said inner cylindrical surface is curved such that the curve is intermediate between a cylindrical surface and the curve of the outer surface, resulting in an anode wall thickness no greater than that resulting from an inner cylindrical wall described in claim 15 and no less than that resulting from a curved surface that matches the outer surface and that yields a constant wall thickness:

34. A liquid cooled stationary anode tube as described in claim 33 wherein the liquid cooled anode heat exchange region is further prepared with a calculated surface roughness whose height is no less than 0:3 that of the coolant liquid viscous sublayer and no greater than the combined thickness of the coolant liquid viscous sublayer and the transition zone.

35. A liquid cooled stationary anode tube as described in claim 30 wherein the liquid cooled anode heat exchange region is further prepared with a calculated surface roughness whose height is no less than 0:3 that of the coolant liquid viscous sublayer and no greater than the combined thickness of the coolant liquid viscous sublayer and the transition zone.

36. An apparatus as described in claim 30 wherein means are provided in the proximity of, but not extending into, the anode heat exchange region to insure that the liquid velocity vector lies generally in the plane containing the axis of said anode.

37. A liquid cooled stationary anode tube as described in claim 21 wherein said anode is composed of two or more segments, each segment being electrically insulated from the other and wherein said segments may be generally conical or cylindrical in shape, and wherein said contoured surface of the outer surface of said anode segments is a concave curve wherein said curve, its origin and the axis of said anode lie in the same plane, and the inner surface of said anode segments being generally linear, which may include said conical or cylindrical shapes, thereby resulting in a variable anode wall thickness, said anode wall thickness being generally thinnest at the apex and thickest toward the base of said conical shape and, said wall thickness of said cylindrical shaped anode segment being thinnest at the center of said concave curve and thickest toward the ends of said curve, the inner surface of said anode segments being where the electron beam impinges and the outer curved surface being the anode heat exchange surface, and wherein a liquid coolant diverter is structured in the anode heat exchange region to provide predetermined liquid flow conditions

38. A liquid cooled stationary anode tube as described in claim 37 wherein said inner surface of said anode segments is now curved to match the outer curved surface such that a constant anode wall thickness results.

39. A liquid cooled stationary anode tube as described in claim 38 wherein the liquid cooled anode heat exchange region is further prepared with a calculated surface roughness whose height is no less than 0:3 that of the coolant liquid viscous sublayer and no greater than the combined thickness of the coolant liquid viscous sublayer and the transition zone.

40. A liquid cooled stationary anode tube as described in claim 37 wherein said inner surface of said anode segments is curved such that the curve is intermediate between a linear surface and the curve of the outer surface, resulting in an anode wall thickness no greater than that resulting from an inner linear wall described in claim 18 and no less than that resulting from a curved surface that matches the outer surface and that yields a constant wall thickness.

41. A liquid cooled stationary anode tube as described in claim 40 wherein the liquid cooled anode heat exchange region is further prepared with a calculated surface roughness whose height is no less than 0:3 that of the coolant liquid viscous sublayer and no greater than the combined thickness of the coolant liquid viscous sublayer and the transition zone.

42. A liquid cooled stationary anode tube as described in claim 37 wherein the liquid cooled anode heat exchange region is further prepared with a calculated surface roughness whose height is no less than 0:3 that of the coolant liquid viscous sublayer and no greater than the combined thickness of the coolant liquid viscous sublayer and the transition zone.

43. In the apparatus of claim 37 the further improvement wherein each said period or curve is provided with ducting for the alternate injection and removal of said coolant:

44. An apparatus as described in claim 37 wherein means are provided in the proximity of, but not extending into, the anode heat exchange region to insure that the liquid velocity vector lies generally in the plane containing the axis of said anode.

45. In the apparatus of claim 37 wherein said predetermined periodic geometry comprises flutes with rounded cusps.

46. An apparatus as described in claim 45, wherein the radius of said cusps is in the range of 1/32 to ¼ of the radius of said flutes, the height of said radiused cusps varying from 0.5 mm to 15 mm above the bottom of said flute and the wall thickness of the said anode as measured from the bottom of the flute varying from 0.2 mm to about 8 mm with the maximum angle of the flute being about 20.

47. An apparatus as described in claim 21 wherein means are provided in the proximity of, but not extending into, the anode heat exchange region to insure that the liquid velocity vector lies generally in the plane containing the axis of said anode.

48. A liquid cooled stationary anode tube comprising:

a. a vacuum envelope;

b. an electron source selected within said vacuum envelope, said electron source oriented such that the electron beam emitted from said electron source impinges on a predetermined region of the anode;

c. a stationary anode assembly and means for effective liquid cooling of said anode at a heat exchange surface, the liquid coolant flow including viscous and transition sublayers;

d. means for the efficient removal of heat from the liquid cooled anode heat exchange surface of said tube anode, said means comprising a calculated roughness formed on the anode heat exchange surface, said roughness height being no less than about 0.3 times the thickness of the viscous sublayer and no greater than about the combined thickness of the viscous sublayer and transition zone, and the liquid for operating at a Reynolds number of at least 1000 in the anode heat exchange region.

49. A liquid cooled stationary target tube as described in claim 48 wherein said contoured surface further comprises means for developing a pressure gradient having a component perpendicular to said anode heat exchange surface.

50. In apparatus of the type including an anode adapted for irradiation by an energy beam along a first portion thereof, and including a heat exchange surface generally overlying and at least generally coextensive with said anode first portion, said apparatus includes means for providing a flow of coolant liquid to remove heat from said heat exchange surface by formation of nucleate vapor bubbles on said heat exchange surface and removal of said nucleate bubbles from said heat exchange surface, the improvement wherein:

said heat exchange surface includes cavities of predetermined dimensions and distribution on said heat exchange surface whereby nucleate bubbles of a predetermined range of sizes, frequency and distribution emanate from said cavities.

51. In the apparatus of claim 50 the further improvement wherein said roughness elements on the anode heat exchange surface are of predetermined geometry to provide an optimum formation of nucleate bubbles.

52. A liquid cooled stationary anode tube comprising:

a. a vacuum envelope;

b. a hollow stationary anode assembly generally circular symmetric about its axis and means for effective liquid cooling of the external surface of said anode at a heat exchange surface;

c. an electron source enclosed within said vacuum envelope said electron source oriented such that the electron beam emitted from said electron source impinges on a predetermined region of the inside surface of said anode;

d. wherein said anode heat exchange surface is provided with periodic curves, said curves being one or more in number and wherein the axis of said anode, said curves and their origins, and the velocity vectors of said liquid lie generally in the same plane said plane being anyone of an infinite number of planes passing through the axis of said anode and wherein a liquid coolant diverter is structured in the anode heat exchange region to provide predetermined liquid flow conditions and said liquid flow generating a pressure gradient having a component perpendicular to the anode heat exchange surface by virtue of said liquid coolant flow interacting with said curved surface of the anode.

53. An apparatus as described in claim 52 wherein said coolant liquid flow includes viscous and transition layers and said curved surfaces are further prepared with a calculated surface roughness such that the roughness height is no less than about 0.3 thickness of the viscous sublayer and no greater than about the combined thickness of the viscous sublayer and transition zone.

54. In the apparatus of claim 52 the further improvement wherein each said period or curve is provided with ducting for the alternate injection and removal of said coolant.

55. In the apparatus of claim 52 wherein said predetermined periodic geometry comprises flutes with rounded cusps.

56. In appparatus of the type including a stationary anode adapted for irradiation by an energy beam, and including a heat exchange surface, said apparatus including means for providing a flow of coolant liquid to remove heat from said heat exchange surface by formation of nucleate vapor bubbles on said heat exchange surface, said liquid tending to include a viscous sublayer adjacent to said heat exchange surface, the improvement wherein said heat exchange surface includes:

means, disposed on said heat exchange surface, for forming pressure gradients in said liquid having a component perpendicular to said heat exchange surface without substantially impeding the relative velocity between the anode heat exchange surface and said liquid, said component having a magnitude directly proportional to the square of the relative velocity between said anode heat exchange surface and said liquid, to facilitate removal of said nucleate bubbles.

57. In apparatus of the type including a stationary anode adapted for irradiation by an energy beam, and including a heat exchange surface, said apparatus including means for providing a flow of coolant liquid to remove heat from said heat exchange surface by formation of nucleate vapor bubbles on said heat exchange surface, said liquid tending to include a viscous sublayer adjacent to said heat exchange surface, the improvement wherein said heat exchange surface includes:

means, disposed on said heat exchange surface, for breaking up said viscous sublayer to facilitate removal of said nucleate bubbles.

58. In the apparatus of claim 57 the improvement wherein said means for breaking up said viscous sublayer comprises roughness elements formed on said heat exchange surface projecting into said liquid.

59. The apparatus of claim 58 wherein said viscous sublayer is of a first predetermined thickness, and said liquid includes a transitional sublayer of a second predetermined thickness adjacent to said viscous sublayer, the improvement wherein said roughness elements project into said liquid one or more distances ranging from 0.3 times said first predetermined distance to the sum of said first and second distances.

60. In the apparatus of claim 58 the further improvement wherein said roughness elements on the anode heat exchange surface are of predetermined geometry to provide an optimum formation of nucleate bubbles.

* * * * *